US007658883B2

(12) United States Patent
Marya et al.

(10) Patent No.: US 7,658,883 B2
(45) Date of Patent: Feb. 9, 2010

(54) INTERSTITIALLY STRENGTHENED HIGH CARBON AND HIGH NITROGEN AUSTENITIC ALLOYS, OILFIELD APPARATUS COMPRISING SAME, AND METHODS OF MAKING AND USING SAME

(75) Inventors: Manuel Marya, Pearland, TX (US); Rashmi Bhavsar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 356 days.

(21) Appl. No.: 11/612,088

(22) Filed: Dec. 18, 2006

(65) Prior Publication Data

US 2008/0141826 A1 Jun. 19, 2008

(51) Int. Cl.

| | |
|---|---|
| ***C21D 1/74*** | (2006.01) |
| ***C22C 38/58*** | (2006.01) |
| ***C22C 38/00*** | (2006.01) |
| ***C22C 33/04*** | (2006.01) |

(52) U.S. Cl. ..... 420/586.1; 420/583; 420/59; 420/65; 420/66; 420/74; 148/329; 148/619; 148/620; 148/707; 148/708; 148/442; 148/327; 148/606

(58) Field of Classification Search ..... 420/59, 420/65, 74, 66, 586.1, 583; 148/619, 620, 148/329, 606, 707, 708, 327, 442
See application file for complete search history.

(56) References Cited

U.S. PATENT DOCUMENTS 2,698,785 A * 1/1955 Jennings ..... 420/42
3,880,654 A * 4/1975 Hartline, III ..... 420/59
4,919,728 A 4/1990 Kohl
5,094,812 A 3/1992 Dulmaine (Continued)

FOREIGN PATENT DOCUMENTS

DE 3940438 5/1991

(Continued)

OTHER PUBLICATIONS

"Mechanical Properties of Carbon and Alloy Steels, Effects of Alloying Elements", pp. 220-221, Metals Handbook, Second Edition, 1998.*

(Continued)

*Primary Examiner*—Deborah Yee
(74) *Attorney, Agent, or Firm*—Edmonds & Nolte, P.C.; Jeremy P. Welch; James L. Kurka

(57) ABSTRACT

Novel carbon-plus-nitrogen corrosion-resistant ferrous and austenitic alloys, apparatus incorporating an inventive alloy, and methods of making and using the apparatus are described. The corrosion-resistant ferrous and austenitic alloys comprise no greater than about 4 wt. % nickel, are characterized by a strength greater than about 700 MPa (100 ksi), and, when being essentially free of molybdenum (<0.3 wt. %), have minimum Pitting Resistance Equivalence (PRE) numbers of 20 and minimum Measure of Alloying for Corrosion Resistance numbers (MARC) of 30 because of the use of both carbon and nitrogen. The ferrous and austenitic alloys are particularly formulated for use in oilfield operations, especially sour oil and gas wells and reservoirs. This abstract allows a searcher or other reader to quickly ascertain the subject matter of the disclosure. It will not be used to interpret or limit the scope or meaning of the claims.

12 Claims, 21 Drawing Sheets

U.S. PATENT DOCUMENTS

| | | | |
|---|---|---|---|
| 5,480,609 | A | 1/1996 | Dupoiron |
| 5,841,046 | A | 11/1998 | Rhodes |
| 6,168,755 | B1 | 1/2001 | Biancaniello |
| 6,454,879 | B1 | 9/2002 | Aigner |
| 2004/0258554 | A1 | 12/2004 | Radon |
| 2005/0047952 | A1 | 3/2005 | Coleman |
| 2005/0145308 | A1 | 7/2005 | Saller |
| 2006/0034724 | A1 | 2/2006 | Hamano |

FOREIGN PATENT DOCUMENTS

| | | | |
|---|---|---|---|
| DE | 19607828 | | 6/2003 |
| EP | 0694626 | A1 | 1/1996 |
| EP | 1051529 | B1 | 12/2001 |
| EP | 1626101 | A1 | 2/2006 |
| JP | 60-39150 | * | 2/1985 |

OTHER PUBLICATIONS

Rawers, J. C., "Characterizing alloy additions to carbon high-nitrogen steel", Proceedings of the Institution of Mechanical Engineers, Journal of Materials: Design and Applications, vol. 218, No. I3, pp. 239-246 (Aug. 2004).

Gavriljuk, et al., "Nitrogen and carbon in austenitic and martensitic steels: atomic interactions and structural stability", Materials Science Forum, vol. 426-432, Part 2, pp. 943950 (2003).

Balanyuk, et al., "Mössbauer study and thermodynamic modeling of Fe-C-N alloy", Acta Materialia, vol. 48, No. 15, pp. 3813-3821 (Sep. 2000).

Jargelius-Pettersson, R.F., "Application of the pitting resistance equivalent concept to some highly alloyed austenitic stainless steels", Corrosion (USA), vol. 54, No. 2, pp. 162-168. (Feb. 1998).

* cited by examiner

FIG. 8C1
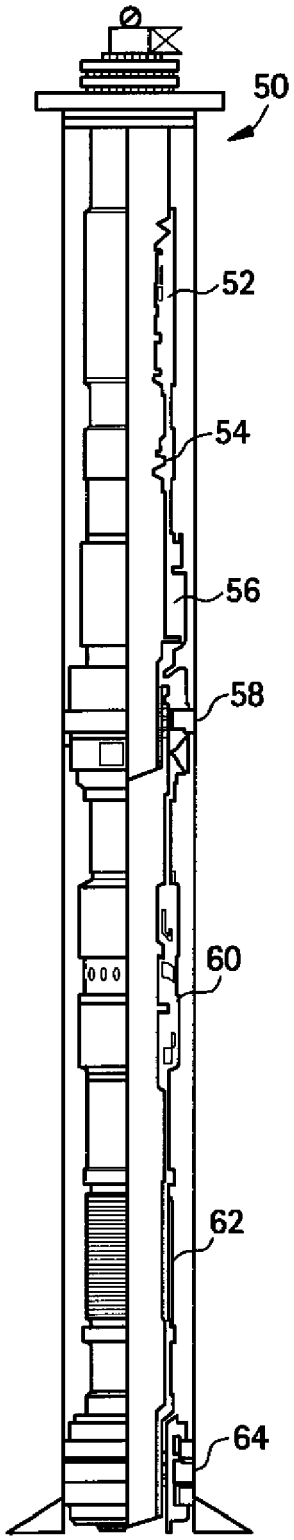
FIG. 8C2
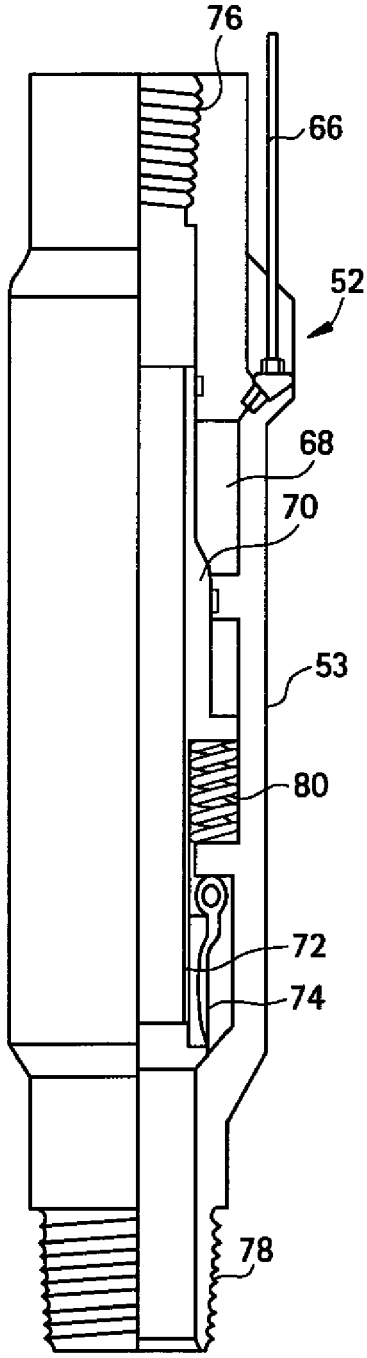
FIG. 8C3
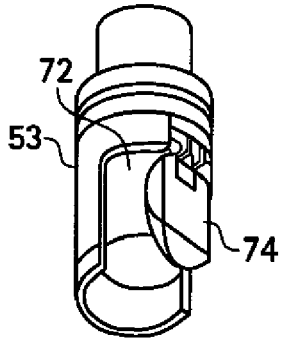

FIG. 8C4
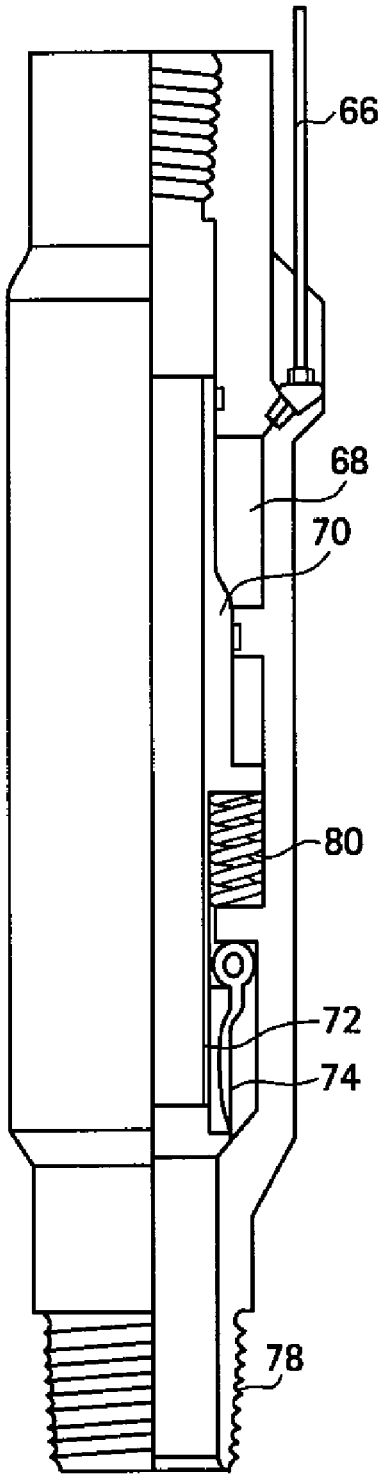
Open
FIG. 8C5
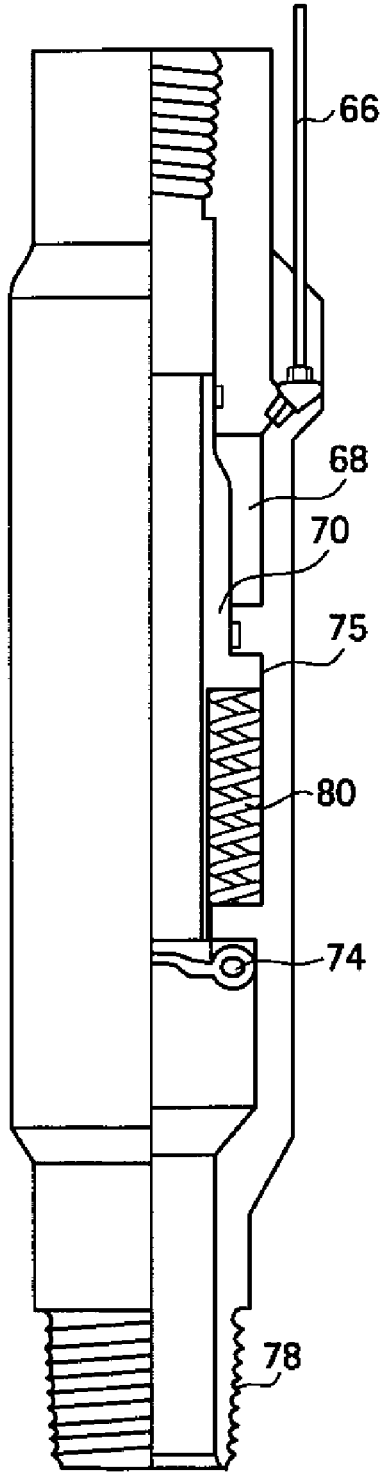
Closed

SEM MAG: 1.30 kx DET: SE
HV: 20.0 kV
50 μm

SEM MAG: 580 x DET: SE
HV: 20.0 kV
100 μm

INTERSTITIALLY STRENGTHENED HIGH CARBON AND HIGH NITROGEN AUSTENITIC ALLOYS, OILFIELD APPARATUS COMPRISING SAME, AND METHODS OF MAKING AND USING SAME

BACKGROUND OF THE INVENTION

1. Field of Invention

The present invention relates to ferrous alloys that possess high-strength, good corrosion resistance in environments such as oilfield exploration, production, and testing, and more specifically to carbon-plus-nitrogen austenitic alloys that are interstitially strengthened, apparatus comprising these novel alloys, and methods of making and using same.

2. Related Art

The art of fabricating corrosion resistant ferrous alloys (including stainless steels and the so-called "high-nitrogen steels") is well-documented (see Kamachi Mudali, U., Baldel Raj, "High Nitrogen Steels and Stainless Steels-Manufacturing, Properties and Applications", Narosa Publishing House, ASM International, New Delhi (2004), hereinafter referred to as "Kamachi"). The use of nitrogen (N) as an alloying element is also well reported; however nitrogen (N) in high contents (or concentrations; in this document the two words are used interchangeably with no distinctions) is still not common, and when utilized nitrogen (N) has been restricted to alloys with low carbon contents. Nitrogen (N) yet continues to be of interest because of its abundance and low price (nitrogen gas, $N_2$, constitutes about 80% of our atmosphere) and the fact that it serves as partial substitute to metallic alloying elements such as nickel (Ni) or chromium (Cr). Indeed, like nickel (Ni), nitrogen (N) is an austenite ($\gamma$) stabilizer (i.e. it stabilizes the austenite, the $\gamma$ and FCC phase of iron), and like chromium (Cr), nitrogen (N) improves corrosion resistance immensely regardless of the fact that chromium (Cr) is a ferrite stabilizer (i.e. it promotes ferrite, the BCC $\alpha$ and $\delta$ phases of iron). In contrast with numerous grades of stainless steels, the high-nitrogen steels are essentially commercially unavailable. Of the various types of ferrous alloys, this invention relates exclusively to austenitic alloys (i.e. alloys that contains austenite, $\gamma$, as the predominant phase), and does thus not include either ferritic or martensitic alloys; two types of ferrous microstructures that are inherently limited by their cracking susceptibility in hydrogen-containing environments, including the sour environments of many oilfields. Specifically, included in this invention are alloys that are made fully austenitic largely due to interstitial carbon (C) and nitrogen (N), and alloys wherein other phases may coexist with the austenite phase but only in minor proportions (e.g. less than 5 wt. %). These minor phases may include other ferrous phases such as ferrite ($\alpha$), martensite (with no restrictions to the various types of martensite), intermetallic phases or compounds of metals and nitrogen (N), carbon (C), or other non-metallic element, even though these phases will generally reduce the overall performance of the alloy in corrosive environments; that is its corrosion resistance. In this document, an alloy will be considered corrosion resistant when it resist the formation of pits and crevices, as well as the formation of cracks, as assisted by the presence of tensile stresses and a aggressive environment, in particular a sour, or $H_2S$-containing environment, and/or a halide containing environment (as in brine or seawater).

U.S. Pat. No. 6,168,755 B1, (Biancaniello, et al.), discloses that a "high-nitrogen stainless steel" may be defined as a stainless steel having a nitrogen (N) content of at least 0.3 wt. %. In the presence of such or higher contents of nitrogen (N), the "high-nitrogen steels" have little or no carbon (C) because carbon (C), chromium (Cr), and other alloying elements commonly interact with carbon (C) to form in coexistence with the ferrous phases a variety of new phases, commonly lowering alloy corrosion resistance. Biancaniello, et al., after mentioning that certain patents (such as U.S. Pat. No. 5,480,609 by Dupoiron, et al.) teach to avoid nitrogen (N) over 0.8 wt. %, describe a high-nitrogen stainless steel having 0.8 to 0.97 wt. % nitrogen (N) with absolutely no carbon (C). U.S. Pat. No. 5,841,046 (Rhodes, et al.) describes a high-nitrogen stainless steel having between 0.8 and 1.1 wt. % nitrogen (N), and also clearly specifies that the new alloy requires solution annealing and water quenching in order to avoid chromium nitride precipitation as well as sigma ($\sigma$) phase; i.e. two phases that accelerate corrosion. EP 16261001A1 (Daido) discloses a high-nitrogen austenitic stainless steel having 0.8 wt. % to 1.5 wt. % nitrogen (N), but is restricted to 0.2 wt. % carbon (C), also to prevent the formation of harmful phases in corrosive environments.

Clearly prior art has been to restrict carbon (C) content to avoid or carefully control carbides, nitrides, carbo-nitrides, sigma ($\sigma$), Chi ($\chi$) phases, or other intermetallic and deleterious phases, especially (but not restrictively) along grain boundaries. The tight control in the contents of these phases is crucial for the alloys to exhibit adequate corrosion resistance as well as good ductility and toughness in service conditions. Table 1 presents a summary list including a great many commercial austenitic stainless steels, among which many have found oilfield applications. In addition to being non-magnetic (paramagnetic), these alloys are all to some extents corrosion resistant, including resistant to environmentally-assisted cracking; i.e. hydrogen and sulfide stress cracking, stress-corrosion cracking, corrosion fatigue, etc (elsewhere, such alloys are often referred as CRAs or corrosion-resistant alloys). Paramagnetism and resistance to embrittlement by hydrogen (H), as promoted by dissolved hydrogen sulfides ($H_2S$) in oil and gas fields, are largely promoted by the fact that alloys of this invention are austenitic, as opposed to ferritic or martensitic. Also shown in Table 1 for these alloys are UNS numbers (designations), chemical compositions, Pitting Resistance Equivalent (PRE) numbers (an index characterizing resistance to pitting corrosion; the higher the PRE is the more corrosion resistant is the alloy), and key mechanical properties. It may be seen for all these alloys that carbon (C) content is tightly controlled to never exceed 0.03 wt %. Likewise, content in nitrogen (N) is frequently less than 0.3 wt. %, as opposed to the high-nitrogen steels for which nitrogen content exceeds 0.3 wt. %. Except with rare exceptions, note that chromium (Cr) is consistently between 16 wt. % and 28 wt. %, nickel (Ni) ranges between 10 wt. % and 46 wt. %, molybdenum (Mo) is always present with a minimum of 0.5 wt. % increased up to 4.0 wt %, whereas manganese (Mn)—a strong austenite ($\gamma$) stabilizer—is not utilized. It is also seen that the chromium-rich and molybdenum-rich austenitic alloys have greater PRE (up to 54) and are thus more corrosion resistant, but also pricier, as shown by the last column of Table 1, and largely explained by the presence of nickel (Mo) and molybdenum (Mo). In stark contrast with the alloys of this invention is also the fact that the minimum yield strength is consistently lesser than 90 MPa (~12 ksi) for most alloys; the exceptions being alloys that falls under the "high-nitrogen steel" category. Differently, the tensile elongation that measures ductility and thus indirectly toughness is relatively high and between 30 and 40 percent regardless of the alloys; a characteristic that makes austenitic alloys advantageous for countless applications, including artic usage where for instance brittle fracture would likely occur in ferritic or martensitic steels. Of all the properties of the commercial alloys of Table 1, their strength is often insufficient for downhole applications and thus constitutes a major disadvantage that prevents them from rivaling the nickel alloys used today in downhole applications, and, when their strength is adequate, these alloys are considerably pricy, thus establishing another limit to their use. However, in part related to their excellent toughness, the austenitic alloys are promising for use in oil and gas applications, especially in sour environments, whereas the martensitic steels are inherently limited by their poor resistance against hydrogen embrittlement (including sulfide stress cracking). FIG. 1 is a histogram chart for the major alloys currently used in oilfield subsurface applications (including completion equipment) showing price estimates per pounds (normalized to that of carbon steels) along with the alloy recommended tensile strengths. While all these alloys may exist in higher strength grades through cold working (work hardening), heat-treatments, or both, note that alloy strength is limited as shown in FIG. 1, largely to comply with NACE MR0175/ISO15153 standards and thus be acceptable by the industry.

In ferrous alloys, the simultaneous use of carbon (C) and nitrogen (N) has been reported in published articles by Rawers and Gavriljuk (Rawers) on iron (Fe) and on Fe-15 wt. % Cr-15 wt. % Mn alloys. As part of this invention, a similar contribution from carbon (C) and nitrogen (N) is proposed for different and more complex alloys that have the advantages of having low-raw material costs, high resistance in corrosive environments—including resistant to sulfide stress cracking (SSC)—, high strengths (>700 MPa; ~100 ksi), and high toughness values (>40J; ~30 ft. lb). Today, there are no carbon-plus-nitrogen commercial alloys available, whether they are stainless or not, and only one patent (to best of our knowledge) on the subject has been found, but for different alloy compositions and entirely-different applications, in stark contrast with the countless patents that have been granted for steels and stainless steels for instance. When compared to the commercial alloys of Table 1, the novel carbon-plus-nitrogen alloys of this invention simply offer new and improved properties, nearly all superior to those listed in Table 1; properties that bring new oilfield applications for these relatively-low cost inventive alloys. Of great interest to downhole applications is the use of these novel alloys in sour conditions, as well as their use at greater depths (e.g. HPHT wells), where today conventional austenitic steels would not be employed.

A number of scientific publications (e.g. journal articles, patents, standards) will serve as references to this document. They will be usually referred in this document by the first author's name or owning company: e.g. Rawers, J. C., "Characterizing alloy additions to carbon high-nitrogen steel", Proceedings of the Institution of Mechanical Engineers, Journal of Materials: Design and Applications, Vol. 218, No. 13, pp. 239-246 (August 2004) (Rawers); Gavriljuk, et al., "Nitrogen and carbon in austenitic and martensitic steels: atomic interactions and structural stability", Materials Science Forum, Vol. 426-432, Part 2, pp. 943950 (2003) (Gavriljuk, et al.); Balanyuk, et al., "Mössbauer study and thermodynamic modeling of Fe—C—N alloy", Acta Materialia, Vol. 48, No. 15, pp. 3813-3821 (September 2000) (Balanyuk, et al.); Saller, et al., US20050145308 A1 (Saller, et al.); Hamano, et al., US20060034724 A1 (Hamano, et al.); ALLVAC Ltd., et al., EP1051529 B1 (ALLVAC); Radon, US 2004/0258554 A1 (Radon), Jargelius-Pettersson, R. F., "Application of the pitting resistance equivalent concept to some highly alloyed austenitic stainless steels", Corrosion (USA), Vol. 54, No. 2, pp. 162-168. (February 1998) (Jargelius-Pettersson); "Petroleum and natural gas industries—Materials for use in $H_2S$-containing Environments in oil and gas production", NACE MR0175/ISO 15156 International Standard; Kovach, C. W., "High-Performance Stainless Steels", Technical report to the Nickel Development Institute.

Published U.S. patent application no. 20050145308 (Saller, et al.) discloses steels comprising, among other ingredients, from 0 wt. % to about 0.35 wt. % carbon (C), and from about 0.35 wt. % to about 1.05 wt. % nitrogen (N). The authors note that hot working a cast piece in one or more steps, an optional subsequent solution annealing of the semi-finished product, and forming at a temperature below the recrystallization temperature (preferably below about 600° C. or 1140° F.) produces a steel essentially free of nitrides, carbides, carbo-nitrides, apparently affording a high fatigue strength under reversed stresses of the same. Being substantially free of nitrogenous and carbide precipitations, parts made of steels may be produced (according to this publication) with both superior mechanical properties and greater stress-corrosion cracking and pitting corrosion resistances. The austenitic alloys of this publication may be employed in principle for drilling string components, such as drill rods for oilfield technology.

Articles made of hot-worked and cold-worked austenitic alloys with up to 0.12 wt. % carbon (C), 0.20 wt. % to 1.00 wt. % silicon (Si), 17.5 wt. % to 20.0 wt. % manganese (Mn), up to 0.05 wt. % phosphorus (P), up to 0.015 wt. % sulfur (S), 17.0 wt. % to 20.0 wt. % chromium (Cr), up to 5 wt. % molybdenum (Mo), up to 3.0 wt. % nickel (Ni), and from 0.8 wt. % to 1.2 wt. % nitrogen (N) are known from DE 39 40 438 C1. However, as noted by some of the same inventors in DE 196 07 828 A1, these articles have modest fatigue strength—at best 375 MPa (55 ksi)—and this fatigue strength is significantly lower in an aggressive environment such as saline environments.

Another austenitic alloy is known from DE 196 07 828 A1, mentioned above. According to this document, articles are proposed for the offshore industry which are made of an austenitic alloy with 0.1 wt. % carbon (C), 8 wt. % to 15 wt. % manganese (Mn), 13 wt. % to 28 wt. % chromium (Cr), 2.5 wt. % to 6 wt. % molybdenum (Mo), 0 wt. % to 5 wt. % nickel (Ni) and 0.55 wt. % to 1.1 wt. % nitrogen (N). Such articles are reported to have high mechanical properties, particularly a higher fatigue strength under reversed stresses than articles according to DE 39 40 438 C1. However, one disadvantage thereof is a low nitrogen (N) solubility that is attributable to the alloy composition, which is why melting and solidification have to be carried out under pressure, or still more burdensome powder metallurgical production methods must be utilized.

An austenitic alloy which results in articles with low magnetic permeability and good mechanical properties with melting at atmospheric pressure is described in AT 407 882 B. Such an alloy has in particular relatively high yield strength, a high tensile strength, and high fatigue strength under reversed stresses. Alloys according to AT 407 882 B are expediently hot worked and subjected to a second forming at temperatures of 350° C. to approximately 600° C. The alloys are said to be suitable for the production of drill rods which also adequately take into account the high demands with respect to static and dynamic loading capacity over long operating periods within the scope of drill use in oilfield technology.

Published U.S. Pat. App. No. 20050047952 (ALLVAC LTD.) discloses an alloy claimed to be non-magnetic, corrosion resistant, galling resistant, and high strength and suitable for use as non-magnetic components in directional drilling of oil and gas wells whose composition by weight includes:

carbon (C) up to 0.2 wt. %; silicon (Si) up to 1.0 wt. %; manganese (Mn) from 10.0 to 20.0 wt. %; chromium (Cr) from 13.5 to 18.0 wt. %; nickel (Ni) from 1.0 to 7.0 wt. %; molybdenum (Mo) from 1.5 to 4.0 wt. %; and nitrogen (N) from 0.2 to 0.4 wt. %, the composition satisfying the formulae: nickel equivalence ($Ni_{eq}$)+chromium equivalence ($Cr_{eq}$) greater than 35; a formula of questionable meaning since nickel and chromium have widely different effects, in particular chromium (Cr) is ferrite stabilizer while nickel (Ni) is an austenite (γ) stabilizer.

The first report of the benefits carbon (C) and nitrogen (N) could bring if used in combination may probably be found in articles co-authored by Gavriljuk et al., in particular the article referred in this patent as Balanyuk, et al. In the referred article, Mössbauer spectroscopy and Monte Carlo computer simulation were combined to understand the reason for the solid-solution stability of iron (Fe) alloyed with 0.93 wt. % carbon (C) and 0.91 wt. % nitrogen (N). Interstitial concentrations in austenite (γ) and ferrite (α) were determined on the basis of X-ray diffraction measurements of the lattice dilatation. The hyperfine structure of Mössbauer spectra was analyzed to identify different atomic configurations in solid solutions and determine their fractions. Thereafter Monte Carlo simulation of the interstitial distribution in ferritic and austenitic solid solutions was performed, and values of the interstitial-interstitial interaction energies were obtained for the first and second coordination spheres in austenite (γ) and the first to the fourth coordination spheres in ferrite (α). Simulations showed that in both austenitic and ferritic phases the interaction of interstitial atoms is characterized by a strong repulsion within the first two coordination spheres. Experimental data and simulated interstitial distributions are consistent and complementary, and Balanyuk, et al. concluded that the absence of interstitial clusters prevents carbide and nitride precipitates and causes the higher thermodynamic stability of Fe—C—N solid solutions as compared with Fe—C and Fe—N ones.

Of all patents, only one (US published patent application no. 20040258554 A1 by Radon)—discloses alloys closer to the austenitic alloys of this invention, but the authors did not appear to have recognized the critical role played by the combination of carbon-plus-nitrogen in solid solution. Furthermore, unlike the austenitic alloys of the present invention, 31 wt. % to about 48 wt. % chromium (Cr) were used by Radon, while nitrogen (N) and carbon (N) contents were slightly more restricted; carbon (C) was between 0.3 wt. % to 2.5 wt. % (thus higher than in this invention) while nitrogen (N) was between 0.01 wt. % to 0.7 wt. %. Though the carbon (C) and nitrogen (N) contents were occasionally similar to those found in this patent, the author always uses more chromium (Cr) than in the alloys of the present invention, and the problem to be solved and the foreseen applications were extremely different.

As described in this document, corrosion is a complex type of damage and the exact behavior of various alloys cannot be precisely predicted in different oilfield environments. The important criteria with respect to corrosion in oil and gas environments are temperature, and concentrations of sulfides ($H_2S$), carbon dioxides ($CO_2$) and halides (e.g. chlorides). The presence of water and its chemical composition also plays an important role. In either designing or selecting alloys for oil and gas applications, primary consideration are given to cracking; including sulfide stress cracking at low temperatures as well as stress-corrosion cracking generally at higher temperatures. All cracking and weight loss, pitting and crevice corrosion are reduced with austenitic alloys of high PRE and MARC numbers. In addition to providing strengths, the carbon-plus-nitrogen austenitic alloys of the present invention, thanks to their high PRE and MARC numbers, are predicted to outperform many currently known alloys and at lower cost estimates. Tables 1 and 2 show the PRE (Pitting Resistance Equivalent) and MARC (Measure of Alloying for Corrosion Resistance) numbers of commercial austenitic alloys. PRE number ranges between 22 and 54, with corresponding MARC numbers as high as 23. These values are in stark contrast with the inventive alloys described in this document. PRE and MARC numbers are defined later in this document.

For oil and gas applications, ferrous and austenitic alloys which simultaneously use carbon (C) and nitrogen (N) in interstitial solid solution, are of great interest, in particular if they have also a high corrosion resistance in a multitude of aggressive environments and possess good mechanical properties, in particular a high 0.2% yield strength (YS) and a high tensile strength (TS). In addition, if these alloys can be melted at atmospheric pressure (and if not, with manageable over pressuring; e.g. 2-3 atmospheres), as it is indented for most of the disclosed compositions, their manufacturing-ability and cost would further guarantee their future industrial acceptance.

TABLE 1

Chemical compositions, PRE numbers (corrosion resistance), mechanical properties and price estimate for a number of commercial stainless steels (Kovach).

| Name | UNS Number | C | N | Cr | Ni | Mo | Cu | Other |
|---|---|---|---|---|---|---|---|---|
| Type 316L | S31603 | 0.03 | 0.10 | 16.0-18.0 | 10.0-14.0 | 2.0-3.0 | — | — |
| Type 317L | S31703 | 0.03 | 0.10 | 18.0-20.0 | 11.0-15.0 | 3.0-4.0 | — | — |
| Alloy 20 | N08020 | 0.07 | — | 19.0-21.0 | 32.0-38.0 | 2.0-3.0 | 3.00-4.00 | (Cb + Ta): 8 × C − 1.00 |
| Alloy 825 | N08825 | 0.05 | — | 19.5-23.5 | 38.0-46.0 | 2.5-3.5 | 1.50-3.50 | Al: 0.2 max, Tl: 0.6-1.2 |
| 317LN | S31753 | 0.03 | 0.10-0.22 | 18.0-20.0 | 11.0-15.0 | 3.0-4.0 | — | — |
| 260 | | 0.03 | 0.16-0.24 | 18.5-21.5 | 13.5-16.5 | 2.5-3.5 | 1.00-2.00 | — |
| 317LM | S31725 | 0.03 | 0.10 | 18.0-20.0 | 13.2-17.5 | 4.0-5.0 | — | — |
| 317LMN | S31726 | 0.03 | 0.10-0.20 | 17.0-20.0 | 13.5-17.5 | 4.0-5.0 | — | — |
| NAS 204X | | 0.04 | — | 25.0 | 25.0 | 2.75 | — | Nb: 10 × C |
| 310MoLN | S31050 | 0.03 | 0.10-0.16 | 24.0-26.0 | 21.0-23.0 | 2.0-3.0 | — | Sl: 0.50 max |
| 700 | N08700 | 0.04 | — | 19.0-23.0 | 24.0-26.0 | 4.3-5.0 | — | Nb: 8 × C − 0.40 |
| 904L | N08904 | 0.02 | — | 19.0-23.0 | 23.0-28.0 | 4.0-5.0 | 1.00-2.00 | — |
| 904LN | | 0.02 | 0.04-0.15 | 19.9-21.0 | 24.0-26.0 | 4.0-5.0 | 1.00-2.00 | |
| 20Mo-4 | N08024 | 0.03 | — | 22.5-25.0 | 35.0-40.0 | 3.5-5.0 | 0.50-1.50 | — |
| 20 Mod | N08320 | 0.05 | — | 21.0-23.0 | 25.0-27.0 | 4.0-6.0 | — | Tl: 4 × C min |
| Alloy 28 | N08028 | 0.02 | — | 26.0-28.0 | 29.5-32.5 | 3.0-4.0 | 0.60-1.40 | — |

TABLE 1-continued

Chemical compositions, PRE numbers (corrosion resistance), mechanical properties and price estimate for a number of commercial stainless steels (Kovach).

| | | | | | | | | |
|---|---|---|---|---|---|---|---|---|
| 20Mo-6 | N08026 | 0.03 | 0.10-0.16 | 22.0-26.0 | 33.0-37.0 | 5.0-6.7 | 2.00-4.00 | — |
| 25-6M0 1925hMo | N08925 | 0.02 | 0.10-0.20 | 19.0-21.0 | 24.0-26.0 | 6.0-7.5 | 0.8-1.5 | — |
| 254N | | 0.03 | 0.20 | 23.0 | 25.0 | 5.50 | — | — |
| 25-6M0 1925hMo | N08926 | 0.02 | 0.15-0.25 | 19.0-21.0 | 24.0-26.0 | 6.0-7.0 | 0.50-1.50 | — |
| SB8 | N08932 | 0.02 | 0.17-0.25 | 24.0-26.0 | 24.0-26.0 | 4.7-5.7 | 1.0-2.0 | — |
| 254 SM0 | S31254 | 0.02 | 0.18-0.22 | 19.5-20.5 | 17.5-18.5 | 6.0-6.5 | 0.50-1.00 | — |
| AL-6XN | N08367 | 0.03 | 0.18-0.25 | 20.0-22.0 | 23.5-25.5 | 6.0-7.0 | 0.75 | — |
| YUS 170 | | 0.03 | 0.25-0.40 | 23.0-26.0 | 12.0-16.0 | 0.50-1.20 | — | — |
| 2419 MoN | | 0.03 | 0.30-0.50 | 23.0-25.0 | 16.0-18.0 | 3.5-4.5 | 0.30-1.00 | Mn: 5.5-6.5 |
| 4565S | S34565 | 0.03 | 0.40-0.60 | 23.0-25.0 | 16.0-18.0 | 3.5-5.0 | — | Mn: 3.5-6.5 |
| B66 | S31266 | 0.030 | 0.35-0.60 | 23.0-25.0 | 21.0-24.0 | 5.0-7.0 | 0.50-3.00 | W: 1.0-3.0<br>Mn: 2.00-4.00 |
| 3127 hMo | N08031 | 0.02 | 0.15-0.25 | 26.0-28.0 | 30.0-32.0 | 6.0-7.0 | 1.00-1.40 | — |
| 654 SM0 | S32654 | 0.02 | 0.45-0.55 | 24.0-26.0 | 21.0-23.0 | 7.0-8.0 | 0.30-0.60 | Mn: 2.0-4.0<br>Cu: 0.3-0.6 |

| | | Tensile Strength (minimum) | | Yield Strength (minimum) | | | Hardness (maximum) | | Raw metal price* (2005 |
|---|---|---|---|---|---|---|---|---|---|
| Name | PRE | ksi | MPa | ksi | MPa | Elongation % | Brinell | HRB | $/lb) |
| Type 316L | 23 | 70 | 485 | 25 | 170 | 40 | 217 | 96 | 2.1 |
| Type 317L | 28 | 75 | 515 | 30 | 205 | 40 | 217 | 96 | 2.5 |
| Alloy 20 | 26 | 80 | 551 | 35 | 241 | 30 | 217 | 96 | 3.7 |
| Alloy 825 | 28 | 85 | 586 | 35 | 241 | 30 | — | — | 4.3 |
| 317LN | 30 | 80 | 550 | 35 | 240 | 40 | 217 | 96 | 2.5 |
| 260 | 29 | 80 | 550 | 40 | 275 | 35 | 217 | — | 2.5 |
| 317LM | 31 | 75 | 515 | 30 | 205 | 40 | 217 | 96 | 3.0 |
| 317LMN | 32 | 80 | 550 | 35 | 240 | 40 | 223 | 97 | 3.0 |
| NAS 204X | 34 | 73 | 500 | 30 | 210 | 35 | 187 | 90 | 3.2 |
| 310MoLN | 32 | 80 | 550 | 35 | 240 | 30 | 217 | 96 | 2.9 |
| 700 | 33 | 80 | 550 | 35 | 240 | 30 | — | 90 | 3.7 |
| 904L | 32 | 71 | 490 | 31 | 220 | 35 | — | — | 3.7 |
| 904LN | 34 | | | | | | | | 3.7 |
| 20Mo-4 | 34 | 80 | 551 | 35 | 241 | 30 | 217 | 96 | 4.5 |
| 20 Mod | 34 | 75 | 517 | 28 | 193 | 35 | — | 95 | 3.9 |
| Alloy 28 | 36 | 73 | 500 | 31 | 214 | 40 | — | — | 3.9 |
| 20Mo-6 | 40 | 80 | 551 | 35 | 251 | 30 | 217 | 96 | 4.9 |
| 25-6M0 1925hMo | — | 94 | 650 | 43 | 295 | 35 | — | — | 4.4 |
| 254N | 41 | 94 | 650 | 43 | 300 | 35 | 217 | 96 | 4.0 |
| 25-6M0 1925hMo | 41 | | | | | | | | 4.3 |
| SB8 | 42 | 79 | 550 | 37 | 250 | 35 | — | — | 4.0 |
| 254 SM0 | 42 | 94 | 650 | 44 | 300 | 35 | 223 | 97 | 3.8 |
| AL-6XN | 43 | 100 | 690 | 45 | 310 | 30 | 240 | — | 4.3 |
| YUS 170 | 29 | 100 | 690 | 43 | 300 | 35 | 217 | 97 | 1.9 |
| 2419 MoN | 39 | 120 | 820 | 67 | 460 | 30 | — | — | 3.1 |
| 4565S | 41 | 115 | 800 | 61 | 420 | 35 | — | — | 3.1 |
| B66 | 45 | | | | | | | | 4.1 |
| 3127 hMo | 48 | 94 | 650 | 40 | 276 | 40 | — | — | 4.9 |
| 654 SM0 | 54 | 109 | 740 | 62 | 425 | 35 | 250 | — | 4.5 |

*Raw material prices were estimated using 2005 average metal prices and a lever rule; i.e. from the percent of each alloying elements. Processing costs are not included in the estimated prices. Prices are subject to the laws of demand and supply and may be very different from those shown in this table.

TABLE 2

Representative corrosion characteristics and applications for high-performance stainless steels (Kovach).

| PRE | MARC | DESCRIPTION | APPLICATIONS (OUTSIDE OILFIELDS) |
|---|---|---|---|
| | | AUSTENITIC ALLOYS | |
| 22-28 | 8 max | Resistance to mid-concentration sulphuric and other strong, mildly reducing or oxidizing acids. Resistance to stress corrosion and pitting (at high PRE number) | Process equipment handling sulphuric acid solutions; condensers and coolers handling acid-chloride condensates where stress corrosion is a problem |
| 30-32 | | Good resistance to mildly acidic, moderate chloride aqueous environments while providing a moderate strength advantage | Piping operating under mild conditions, equipment requiring improved performance compared to Type 316 |

TABLE 2-continued

Representative corrosion characteristics and applications for high-performance stainless steels (Kovach).

| PRE | MARC | DESCRIPTION | APPLICATIONS (OUTSIDE OILFIELDS) |
|---|---|---|---|
| 32-36 | 13-15 | Good general and stress corrosion resistance in strong acids at moderate temperatures and in organic acids at high temperatures | General process equipment |
| 40-43 | 14-21 | Very good chloride pitting and stress corrosion resistance; resists seawater and many saline acidic waters, and many acids and caustics; provides a substantial strength advantage | Process equipment for all but strong reducing and hot sulphuric acids; piping and heat exchangers handling ambient seawater |
| 29-41 | | Very high strength and good general corrosion and pitting resistance | Where high strength is important |
| 45-54 | 13-23 | Very high strength with excellent chloride pitting and stress corrosion resistance, resists warm seawater and high chloride, acidic and oxidizing waters and brines; excellent resistance to a wide variety of acids and caustics | Process equipment for all but strong reducing and hot sulphuric acids; piping and heat exchangers/evaporators handling hot seawater and brines |
| | | FERRITIC ALLOYS | |
| 27 | 8 | Excellent chloride stress corrosion cracking resistance, good resistance to pitting; excellent resistance to hot organic acids and caustics | Heat exchanger tubing handling fresh water, organic acid condensers, caustic evaporator tubing |
| 34-40 | 4-14 | Resistant to pitting and crevice corrosion in ambient temperature seawater; good stress corrosion resistance in high temperature water; good strength | Seawater-cooled condenser tubing; heat exchanger tubing handling fresh and brackish water and organic acids |
| | | DUPLEX ALLOYS | |
| 22 | 8 max | Good stress corrosion resistance in cooling waters and under evaporative conditions; high strength | Equipment handling water, foods, and pharmaceuticals where better strength or stress corrosion resistance is needed compared to Type 304 |
| 30-34 | 5-12 | Good pitting and stress corrosion resistance; good resistance to oxidizing acids and caustics; high strength | Pressure vessels, piping, pumps and valves where strength and weight are factors along with resistance to stress corrosion and fatigue |
| 32-39 | 7-15 | Very good pitting and stress corrosion resistance, good resistance to mildly reducing and oxidizing acids and caustics; high strength | Where better pitting and crevice corrosion resistance is needed compared to the D-2 alloys |
| 36-38 | 10-14 | Resistance to seawater pitting and crevice corrosion; very good stress corrosion resistance; good resistance to mildly reducing acids and oxidizing acids and caustics; high strength | Pumps, valves, and high pressure piping and pressure tubing handling seawater or chloride containing waters |

SUMMARY OF THE INVENTION

In the present invention are described corrosion-resistant ferrous alloys that have less than about 4.0 wt. % nickel and, in the near-absence of molybdenum (e.g. <0.3 wt. %) have a minimum PRE (Pitting Resistance Equivalence) number of about 20, and a minimum MARC (Measure of Alloying for Corrosion Resistance) number of about 30, and in the presence of up to 3 wt. % molybdenum have PRE and MARC numbers as high as 90 and 100, respectively. Alloys of this invention are characterized by having large interstitial carbon (C) and nitrogen (C), each ranging from about 0.4 to 1.2 wt. %, and may be extremely useful in the oil and gas industry, particularly for downhole use. The inventive alloys offer outstanding combinations of corrosion resistances (including cracking resistance in normally-considered corrosive and sour environments), high strengths (greater than about 700 MPa (100 ksi)), high toughnesses (greater than about 40 J; (30 ft. lb)), and lower raw-material prices than commercial alloys with comparable mechanical and corrosion properties (e.g. nickel alloys). As used herein "corrosion-resistant" means that the inventive ferrous alloys resist pitting (as revealed by their high PRE numbers), the formation of crevices (as revealed by their high MARC numbers) and cracks under stressed conditions and in a variety of environments that may comprise halides (e.g. chlorides), sulfides, carbon dioxide, among other chemicals. Together with their high PRE and MARC numbers, because of their predominantly austenitic microstructure, the inventive alloys are sulfide stress cracking resistant; e.g. they are unlikely to fail in sour environments, wherein sulfide partial pressure would normally exceed 0.05 psi (0.35 kPa), as defined by NACE MR0175/ISO15156 standards. This invention therefore primarily discloses novel austenitic stainless alloys wherein carbon (C) and nitrogen (N) act synergistically, as opposed to regular alloys, and wherein nitrogen (N) essentially substitutes the effect of pricier alloying elements such as nickel (Ni) to produce low-cost corrosion-resistant austenitic alloys. The ferrous alloys of the invention are characterized by minimum yield strength (YS) ranging from about 700 to about 1000 MPa (about 100 to about 150 ksi) without cold working (or work-hardening), and superior chemical resistance in oilfield environments. Strength in the inventive alloys is mainly achieved by the large solid solution caused by carbon (C) and nitrogen (C). Unique to this invention is the application of alloy addition of both carbon (C) and nitrogen (N) with each in excess of approximately 0.4 wt % for new alloys specifically designed for oilfield services, and especially downhole environments.

Ferrous alloys of the invention are relatively low-cost because of the substitution of austenite (γ) stabilizing metals by nitrogen (N). Contents of carbon (C) and nitrogen (N) are such that the equilibrium phases of the inventive ferrous alloys are predominantly if not solely austenitic; occasionally carbide, nitride, carbonitride hard phase may form but may be dissolve through heat treatments. In the inventive alloys, the absence of delta ferrite (δ) upon solidification is important to prevent porosity (voids), and provides high levels of soluble nitrogen (N). The selection and content of alloying elements is thus not only dictated by the corrosion resistance, but also by the high interstitial carbon (C) and nitrogen (N) needed by the austenitic microstructure to exhibit a high corrosion resistance and a considerable strength.

In certain embodiments of the inventive alloys, sufficient chromium (Cr) may be present in order to render the alloy stainless as well as increase the nitrogen (N) solubility in both the liquid and austenite (γ), while manganese (Mn) is necessary to prevent delta ferrite (δ) formation upon solidification and enhance the nitrogen (N) solubility in both the liquid and the austenite (γ). This is in stark contrast with the alloys listed in Table 1, wherein manganese (Mn) is absent and carbon (C) and nitrogen (N) are neither combined nor used significantly. For high corrosion resistance and high nitrogen (N) solubility, exemplary embodiments of the inventive ferrous alloys comprise from about 12 wt. % to 30 wt. % chromium (Cr). Certain other embodiments of the inventive ferrous alloys may comprise from about 8 wt. % to about 30 wt. % manganese (Mn); like chromium (Cr), an alloying element utilized to boost nitrogen (N) solubility over 0.4 wt. %. Other embodiments of the inventive ferrous alloys may comprise one or more of nickel (Ni) and cobalt (Co) wherein the total ranges from about 1.0 wt. % to approximately 4.0 wt. %. Other embodiments of the inventive ferrous alloys may comprise from about 0.1 wt. % to about 2.0 wt. % silicon (Si); an alloying element used to deoxidize and free the alloy from oxygen (O) interstitials. Yet other embodiments of the inventive ferrous alloys may comprise one or more of molybdenum (Mo), titanium (Ti), niobium (Nb), zirconium (Zr), vanadium (V), and tungsten (W), wherein the total of these is less than or equal to about 0.5 wt. % to provide strong substitutional solid solution but avoid significant carbides and other phases from forming, unless desired. Other embodiments of the inventive ferrous alloys may comprise aluminum (Al) up to about 0.5 wt. %. In all embodiments, sulfur (S) and phosphorous (P) must be practically absent so as to enable large solubility for carbon (C) and nitrogen (N), prevent cracking upon during solidification, prevent the formation of deleterious phases such as sulfides and phosphides, and prevent embrittlement (e.g. ductility loss).

In other embodiments the inventive austenitic alloys possess the compositions just as described in [0018] but may comprise up to approximately 3 wt. % molybdenum (Mo); an alloying element that if trapped in solid-solution in the ferrous austenitic matrix improves corrosion resistance considerably. If precipitation of undesirable phases out of the austenite phase is observed, for instance molybdenum carbides, the alloys must be solution annealed (solutionized) at temperatures that generally exceed 1050° C. (1950° F.) for a prolonged time (up to several days), and then rapidly cooled (i.e. quenched), as further explained in the detailed description.

The functions of the various alloying elements are explained in greater detail in the detailed description of the invention.

Another aspect of the invention is an apparatus comprising at least one ferrous alloy of the invention. Apparatus within the invention include oilfield elements, wherein the oilfield element may be selected from completion or downhole tubular (strings, casings), packers, connectors, submersible pump components (pump shafts, casings, impellers, etc), mandrels and components thereof, sensors, blow-out preventer components, bottom hole assemblies (BHA) or components thereof, sucker rods, seals, valve components, power cables, communication wires and cables, bulkheads such as those used in fiber optic connections and other tools, pressure sealing elements for fluids (gas, liquid, or combinations thereof), sand screens, and the like. Exemplary apparatus of the invention are completion accessories, including tubing-mounted equipment and flow control equipment, both of which may be used to customize well completions. Tubing-mounted equipment includes, but is not limited to, sliding sleeves, landing nipples, expansion joints, pumpout subs, and other specialized items that are included in most tubing strings for production or injection operations in the oil and gas industry. Flow-control comprises equipment that is deployed inside the tubing string with standard slickline methods. This includes locks, blanking plugs, equalizing standing valves, circulating plugs, and other specialized equipment. These tools are used to control flow into or from the reservoir. A non-exhaustive list of completion accessories which may comprise one or more ferrous alloys of the invention exposed to downhole conditions during their use is provided in the detailed description.

The present invention also includes processes for producing an austenitic alloy component, comprising, in the following order:

(a) melting (casting) ferrous alloy constituents, metals, alloys, and/or nitrogen-containing solid ingredients (e.g. metal nitrides such as chromium nitrides), all in the form of ingots, pellets, shots and the like in a controlled environment (temperature, pressure, atmosphere) to produce a nitrogen-enriched liquid alloy, wherein evaporation losses of nitrogen (N) and manganese (Mn) are controlled; meaning reduced to the greatest extents through the use of appropriate melt temperature, pressure (at least 1 atm; 0.1 MPa) and atmosphere; e.g. nitrogen gas ($N_2$).

(b) cooling the liquid alloy to form an substantially austenitic alloy under conditions (described by average cooling rates, pressures and nitrogen pressures) that are sufficient to substantially maintain the desired manganese (Mn) content, and thus the appropriate nitrogen (N) in solid solution in the austenitic alloy;

(c) solution annealing (solutionizing) and forging (hot working) the alloy into a near-net shape apparatus such as an ingot, a bar, or a sheet, preferentially in a heat-treating furnace environment enriched in nitrogen gas ($N_2$) to enable further nitrogen (N) solid solution in the alloy; as in the case of sheet products for instance; and (d) in the presence or likelihood of carbides, nitrides, carbo-nitrides, sigma (σ), chi (χ), and other corrosion-susceptible phases seen after casting, rapid cooling (e.g. water, oil quenching) from a solution annealing (solutionizing) temperature, where these phases are dissolved in the austenitic matrix so that the alloy has essentially a single austenite phase.

Certain processes of the invention comprise melting (for example casting) the alloy constituents in an inert or nitrogen-enriched atmosphere, maintaining the alloy melt at temperatures slightly above the alloy solidification temperatures (e.g. >1400° C.; ~2580° F.) prior to pouring/solidification, and cooling—preferentially fast (quench)—the alloy under a nitrogen-enriched atmosphere, in certain embodiments under an increased nitrogen gas ($N_2$) pressure to prevent nitrogen (N) degassing from the melt prior to solidification. Other embodiments comprise homogenizing (solution annealing) in a nitrogen-rich atmosphere, to allow for sufficient nitrogen (N) absorption and homogenization in the austenite (γ), and the dissolution of any undesired phases such as carbides, nitrides, carbon-nitrides, and the like. In certain embodiments the cooling of the alloy may take place in a nitrogen-controlled environment, and/or rapid cooling at rates greater than 50° C./min may be employed to prevent nitrogen (N) degassing; for instance by pouring into a colder crucible and/or contacting the melt free surface with liquid nitrogen ($N_2$). The nitrogen (N) enrichment may be also achieved through metal-nitride additions, for instance chromium nitrides ($Cr_2N$) powders. The enriching and casting step may be carried out at temperatures ranging from slightly above 1400° C. (to be adjusted according to alloy meting temperature) to about 1600° C. (a slight superheating), and minimum pressure of 1 atm (0.1 MPa) up to about 3 atm (0.3 MPa). In certain process embodiments the enriching and casting may take place at ambient pressure, in particular with the richest chromium (Cr) and manganese (Mn) contents (e.g. 25 to 30 wt. % of each). Homogenizing, hot working, and recrystallizing may occur at ambient pressure and may take place at temperatures wherein carbides, nitrides, carbonitrides would be thermodynamically unstable; i.e. at temperatures that depend upon specific alloy composition, typically in excess of about 1050° C. Rapid cooling (quenching) may be conducted using water or oil for instance.

Another major aspect of the invention includes methods of using an apparatus of the invention in performing a defined task, one method comprising:

(a) formulating a ferrous alloy of the invention;

(b) shaping the ferrous alloy into an apparatus or component thereof able to be deployed in a defined environment; and (c) deploying the apparatus or component thereof during an operation in the defined environment.

Methods of using an apparatus of the invention may include, but are not limited to, those wherein the defined environment is an oilfield environment, the apparatus is an oilfield element, and the operation is an oilfield operation. Oilfield operations within the invention include completion operations, acidizing, fracturing, flow diverting and other operations. The environmental conditions of the wellbore during running and retrieving may be the same or different from the environmental conditions during use in the wellbore or at the surface. Methods of the invention include those comprising using a first oilfield element to perform a first task, and a second oilfield element to perform a second task.

The various aspects of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which:

FIG. 11 shows the inventive alloys are austenitic despite having very low contents in nickel (Ni).

Figure 8A:
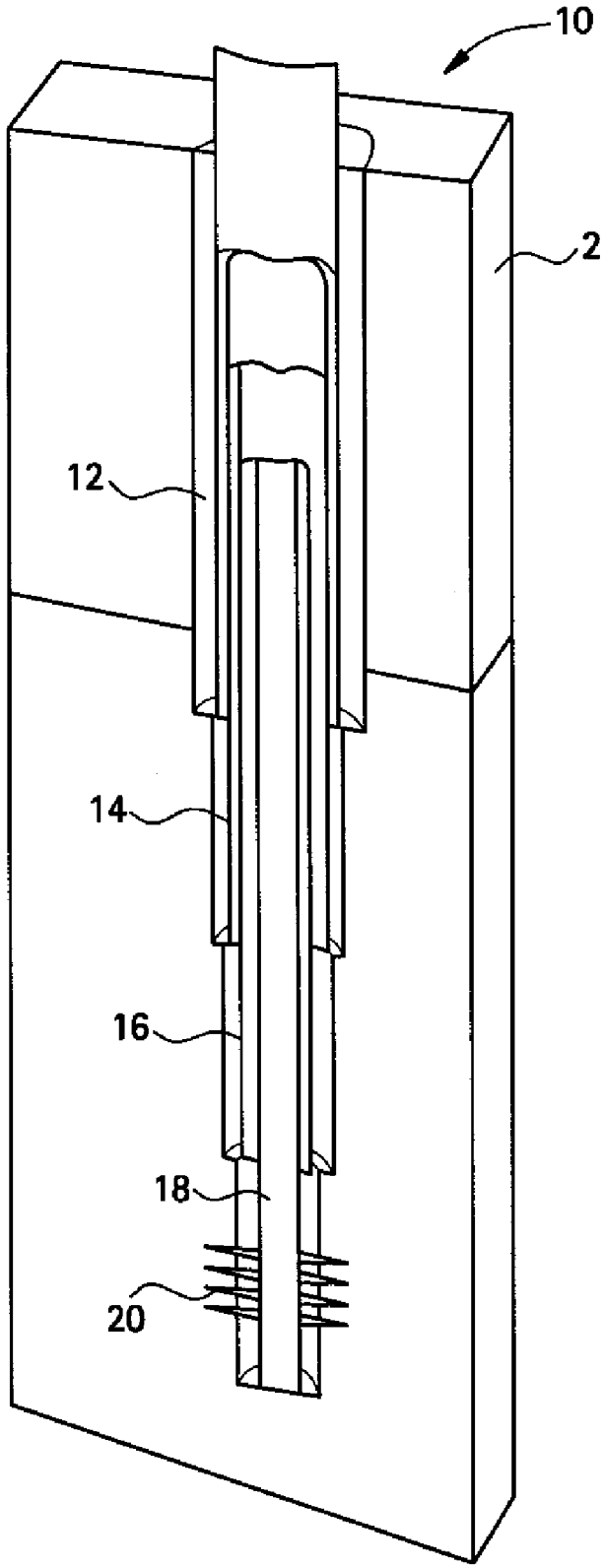
FIGS. 8 to 10 are schematic cross-sectional views of apparatus embodiments of the invention.
Figure 8B:
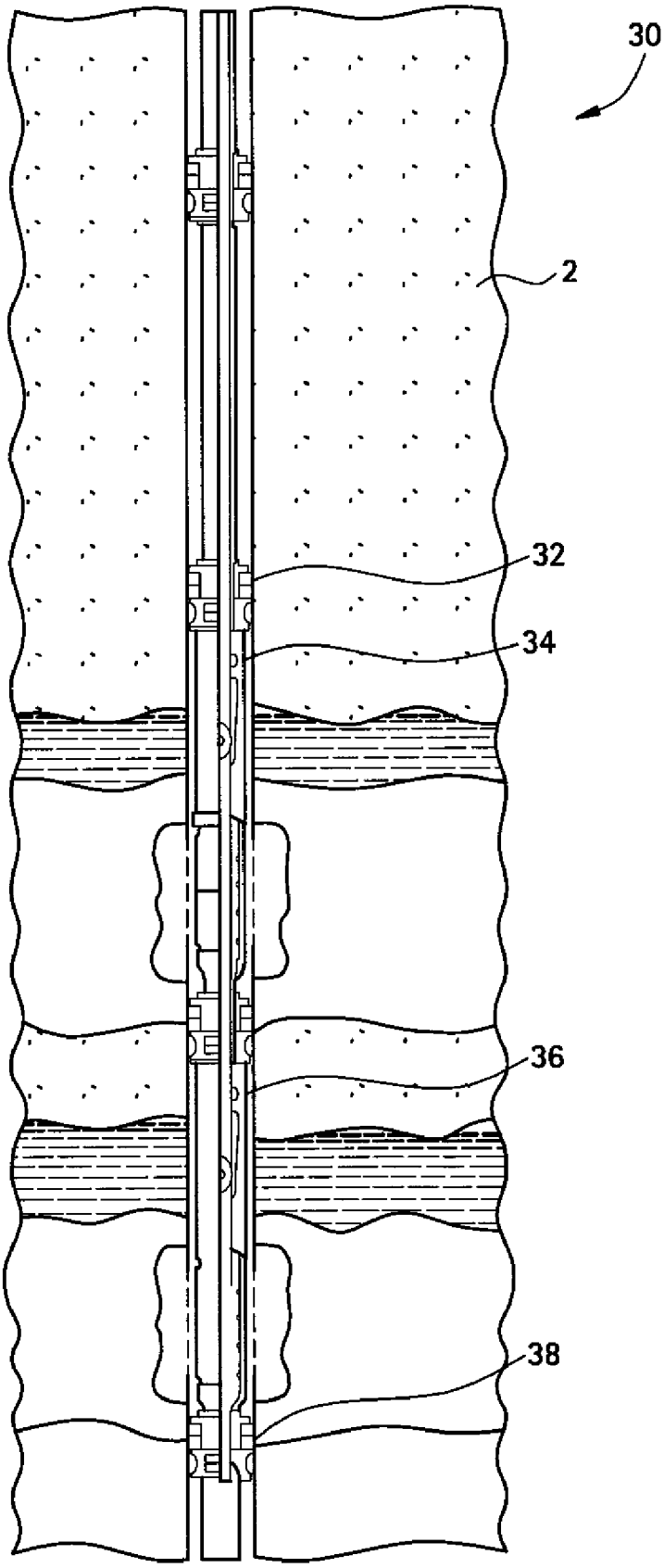
Figure 9:
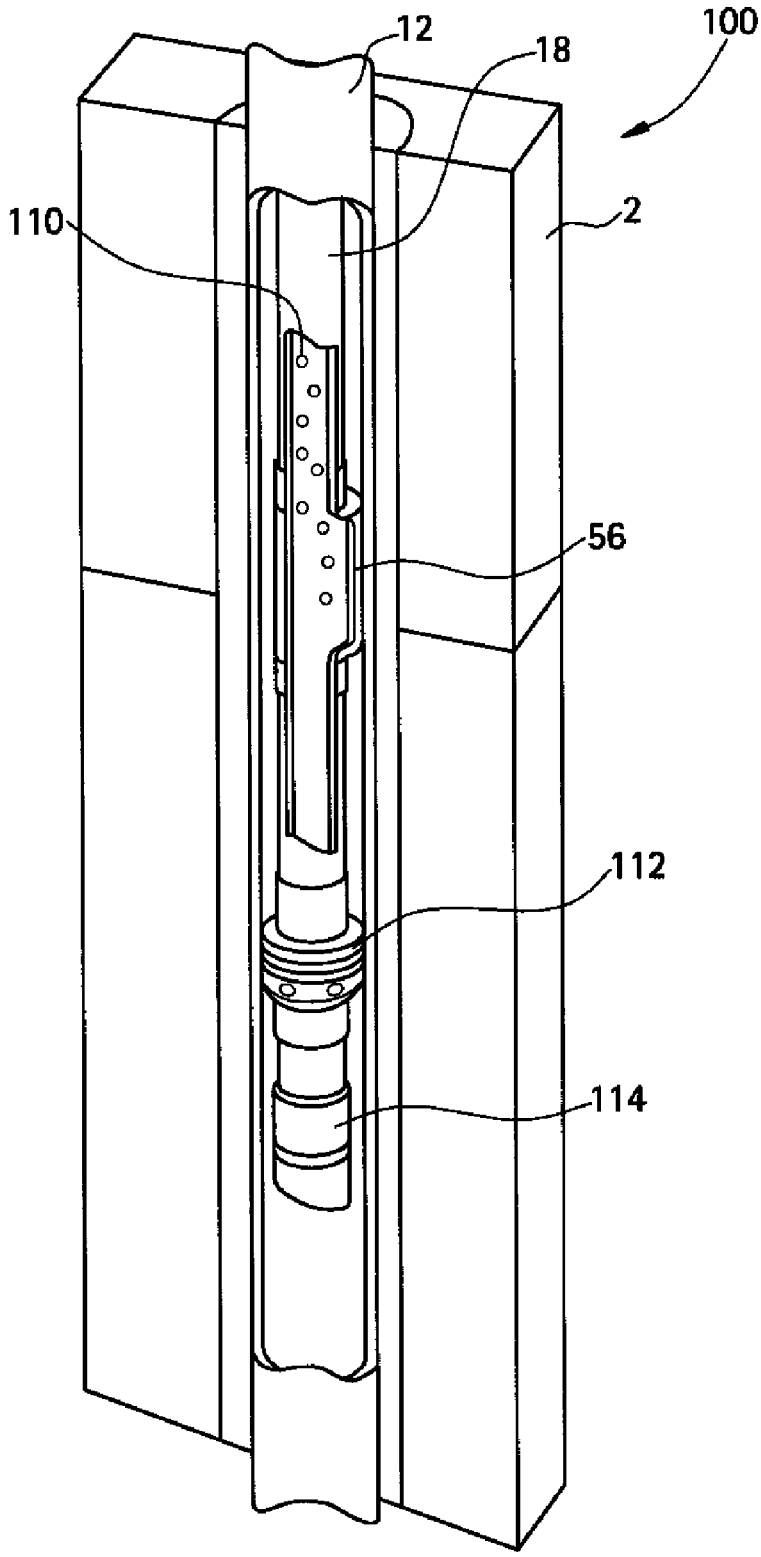

It is to be noted, however, that FIGS. 8-10 of the appended drawings of oilfield elements are highly schematic, not necessarily to scale, and illustrate only typical apparatus embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Described herein are inventive ferrous alloy compositions, shaped articles of manufacture (apparatus) employing one or more of the inventive ferrous alloys, and methods of making and using the apparatus, particularly as oilfield elements. Oilfield applications may include exploration, drilling, and production activities including producing water wherein oil or gaseous hydrocarbons are or were expected. As used herein the term "oilfield" includes land based (surface and subsurface) and sub-seabed applications, and in certain instances seawater applications, such as when exploration, drilling, or production equipment is deployed through a water column. The term "oilfield" as used herein includes oil and gas reservoirs, and formations or portions of formations where oil and gas are expected but may ultimately only contain water, brine, or some other composition.

An "oilfield element" is an apparatus that is strictly intended for oilfield applications, which may include above-ground (surface) and below-ground applications, and a "well operating element" is an oilfield element that is utilized in a well operation. Well operations include, but are not limited to, well stimulation operations, such as hydraulic fracturing, acidizing, acid fracturing, fracture acidizing, fluid diversion or any other well treatment, whether or not performed to restore or enhance the productivity of a well.

The weight percentages given in the present specification and in the appended claims are based on the total weight of the alloy.

This invention describes novel carbon-plus-nitrogen austenitic ferrous alloys that are particularly adept in oilfield services, in particular for sour services; however because of their superior strength and corrosion resistance, the austenitic alloys of this invention also offer new advantages elsewhere. In contrast with current stainless steels (including the so-called "high nitrogen steels") where carbon is undesirable and thus restricted to avert carbides, nitrides, carbo-nitrides, sigma (σ), Chi (c), the inventive alloys possess both carbon (C) and nitrogen (N), not only promote predominantly austenitic microstructures, but also to produce strong alloys without the need for cold-working. Nonetheless, by being austenitic, the inventive alloys would respond well to cold working (work-hardening) and may be strengthened well beyond 1000 MPa (~150 ksi), as suggested by their high ultimate tensile strength. Depending upon alloying elements, certain ferrous inventive alloys will possess up to about 1.2 wt. % of each carbon (C) and nitrogen (N) trapped in interstitial sites in the austenite phase (γ). Carbon (C) and nitrogen (N) in specific concentrations over 0.4 wt %, and in certain embodiments up to about 1.2 wt. % are here proposed as low-cost alloying elements to produce high-strength (greater than about 700 MPa; ~100 ksi), high toughness (greater than about 40 J; ~30 ft. lb), and general corrosion resistant alloys. As a requirement to guarantee a high general corrosion resistance, the inventive ferrous alloys have high PRE and MARC numbers, often considerably greater than commercial alloys, and are therefore anticipated to resist cracking in a multitude of oilfield corrosive environments; including halides (e.g. chlorides), carbon dioxide ($CO_2$), hydrogen sulfides ($H_2S$), and the like. Note that until the inventive alloys are being used in diverse downhole environments, their corrosion resistance will not be fully demonstrated. However, high PRE and MARC numbers are very strong indications that these innovative alloys are highly corrosion resistance, and, when comparing their PRE and MARC numbers with that of commercial alloys, the inventive alloys are in many aspects superior and often have lower raw-material costs.

Figure 1:
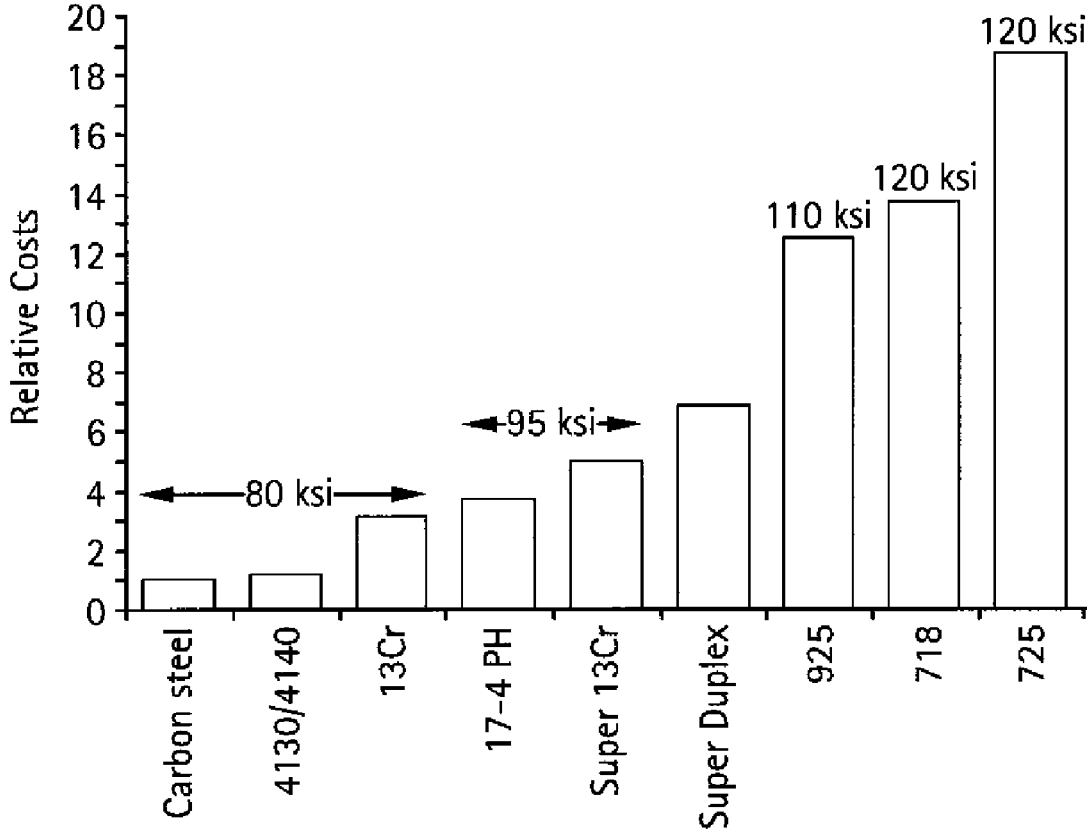
FIG. 1 shows a comparative bar chart for the costs and the properties of alloys currently in use in oilfield downhole applications. The prices have been normalized to that of the carbon steels (Fe—C type alloys).

The austenitic ferrous alloys of the invention are characterized by yield strengths in excess of about 700 MPa (~100 ksi) without cold work (or work hardening), high resistance to pitting (PRE greater than about 20 without molybdenum) and crevice corrosion (MARC greater than about 30 without molybdenum). In certain embodiments, the inventive ferrous alloys may also be characterized as having tensile strengths over about 1400 MPa (~200 ksi), high work-hardening (strain-hardening) rate (a property that indirectly raises safety margin for design), toughness values well beyond about 40 J (~35 ft/lbs) (a minimum typically required in well completion tools), high sulfide stress cracking (SSC) resistance, and non-magnetism as offered by the austenitic structures, high stress corrosion cracking resistance, and good—fatigue—wear—erosion—impact resistances, and good processability (castability, weldability, machinability, formability). Owing to their low nickel (Ni) content, the inventive carbon-plus-nitrogen alloys have relatively low raw-material costs while offering strengths approaching those of martensitic alloys (i.e. generally with tempered martensite) or nickel alloys already in use in the oilfields, as illustrated by FIG. 1. In FIG. 1 are shown the relative costs of oilfield alloys with respect to carbon steels. The ferrous alloys of this invention, purposely not included in FIG. 1, arc predicted to approximate the cost of 13Cr alloys (i.e. stainless steel 410) while exhibiting superior strengths, toughnesses, corrosion resistances, and performances in sour environments than the alloys of FIG. 1 due to their austenitic microstructures. The alloys of this invention are somewhat closer in properties to the 718 and 725 nickel-alloys shown in FIG. 1; however their raw-material is advantageously less.

The inventive ferrous alloys are designed to be single-phase austenitic alloys even though other phases such as carbides, nitrides, carbo-nitrides, sigma (σ), Chi (χ), or even strain-induced martensite, may be produced in minor proportion under certain conditions. The inventive alloys are also non-magnetic (paramagnetic); therefore they will not interfere with downhole electronics (e.g. sensors), and their properties are at least comparable if not superior to conventional Fe—Cr—Ni stainless steels despite being leaner in nickel (Ni). Because of the extensive use of carbon (C) and nitrogen (N), two remarkably strong austenite (γ) stabilizing elements, these alloys are characterized by having low raw material costs. New stainless alloys particularly lean in nickel (Ni<4 wt. %) for oil and gas applications are therefore part of this invention only if their carbon (C) and nitrogen (N) contents stay within the limits of 0.4 wt. % up to about 1.2 wt. %. Nickel-free austenitic steels are discussed in the literature (see e.g., Kamachi) and the object of other patents (see e.g., Daido). The present invention provides austenitic ferrous alloys with ranges of chemical compositions listed in Table 3. Table 3 also summarizes the major functional contributions of each alloying element, and these functions are explained more fully next.

The effects of the respective elements individually and in interaction with the other alloy constituents are now described in more detail.

Carbon (C) may be present in certain ferrous alloys according to the invention up to about 1.2 wt. %. Carbon (C) is the traditional and the major alloying element in low-alloyed and alloyed steels, but not in Fe—Ni—Cr stainless steels because carbon (C) typically causes sensitization; e.g. a degradation of the alloy corrosion resistance. Carbon (C), other than being readily available and inexpensive is also an extremely efficient austenite (γ) former. Furthermore, carbon promotes high strengths in alloys through a variety of mechanisms. Carbon (C) is used in the alloy of the invention, as a solid-solution element; its effects are linked to that of nitrogen (N).

Nitrogen (N) is beneficial in contents of from about 0.4 wt. % to about 1.2 wt. % in order to ensure both a stable austenite (7) structure and a high strength. Furthermore, nitrogen (N) in solid solution is well-known to promote passivity, widens the passive range in which pitting is less probable, improves stress corrosion-cracking, enhances resistance to intergranular corrosion. In solid solution, nitrogen (N) contents from about 0.4 wt. % to about 1.2 wt. % are favorable. On the other hand, nitrogen has the tendency to form nitrides or other nitrogenous precipitations, e.g., $Cr_2N$. A major part of this invention is the fact that carbon (C) and nitrogen (N) are deliberately added in excess of about 0.4 wt. % and in nearly equal contents. Then carbon (C) and nitrogen (N) often not form nitrides, carbides, and carbonitrides or other like phases, and if they do, they may be dissolved by a post-casting heat treatment.

Chromium (Cr) is present in contents from about 12 wt. % up to about 30 wt. % to provide passivity (resistance to corrosion), and improve nitrogen (N) solubility. Chromium (Cr) contents ranging from about 13.0 wt. % to about 30 wt. % are particularly advantageous to improve nitrogen solubility in the alloy, in both the liquid and the solid phases. With 30 wt. % chromium (Cr) and no manganese (Mn), nitrogen (N) content may reach as much as 1 wt. % in casting conditions.

Nickel (Ni) and cobalt (Co) are present in combined total between approximately 1.0 wt. % and 4.0 wt. %. These elements contribute actively and positively to corrosion resistance. Certain inventive alloys may have from about 0 wt. % to about 4 wt. % nickel (Ni) and cobalt (Co). As cobalt is presently more expensive than nickel (Ni), alloys of the invention may comprise more nickel (Ni) than cobalt (Co). Small nickel (Ni) contents are needed for the inventive alloys to passivate well, or repassivate in case of scratches and freshly exposed bulk metal.

Manganese (Mn) is present in contents from about 8 wt. % up to about 30 wt. %. Manganese contributes substantially to nitrogen (N) solubility, but may be detrimental to corrosion resistance. While high manganese concentrations are beneficial to improve nitrogen solubility to the 1 wt. % level in alloys that may be cast at ambient-atmosphere, manganese is highly volatile at melt temperatures and requires safety precautions. The detrimental effects of manganese to corrosion resistance are largely counterbalanced by the positive contributions from chromium (Cr), nitrogen (N) and carbon (C).

Molybdenum (Mo) is usually not used in the alloys of this invention as it was observed to form very stable carbide phases, but may be present in alloys of the invention up to about 3 wt. % providing that solution annealing (solutionizing) at temperatures above 2000° F. for extended periods (sometimes days) is made available (i.e. found practical). When trapped in the austenite phase (γ) and not in the forms of carbides for instance, molybdenum (Mo) contributes in improving general corrosion resistance, including sulfide stress cracking resistance (SSC). Molybdenum (Mo) also promotes high PRE (Pitting Resistance Equivalent) and MARC (Measure of Alloying for Corrosion Resistance) numbers, thus improving the overall alloy corrosion resistance.

Silicon (Si) may be present in concentrations ranging from 0 wt. % up to about 2.0 wt. %. Silicon (Si) is a strong deoxidizer; however it also tends to reduce nitrogen (N) solubility so that its use is restricted.

Titanium, (Ti), niobium (Nb), zirconium, (Zr), vanadium (V), and tungsten (W), may be present up to about 0.4 wt. %. These elements may be found as carbides, nitrides, and carbonitrides; all of which may be dissolved by a high-temperature post-casting heat treatment consisting of solutioning and quenching (detailed later). They all tend increase strength through solid substitution and nitrogen (N) solubility. They may also function as grain refiners.

Aluminum (Al) may optionally be present up to about 0.5 wt. %. Aluminum, like other alkaline and alkaline-earth elements function as deoxidizers, thereby promoting carbon-plus-nitrogen in interstitial sites, as well as trap sites that in theory augment alloy resistance against hydrogen cracking.

TABLE 3

Composition ranges for ferrous alloys of this invention.

| Alloying element | Min (wt. %) | Max (wt. %) | Preferred (wt. %) | Major contributions |
|---|---|---|---|---|
| Carbon, C | 0.4 | 1.2 | 1.0 | Austenite stability and solid-solution strengthening |
| Nitrogen, N | 0.4 | 1.2 | 1.2 | Austenite stability and strengthening |
| Chromium, Cr | 12 | 30 | 13 to 30 | Passivity (corrosion resistance); improves nitrogen solubility |
| Nickel, Ni<br>Cobalt, Co | 1.0 | 4.0 | 2 to 4 | Promotes repassivation though nickel is detrimental to pitting & crevice corrosion in large concentrations |
| Manganese, Mn | 8 | 30 | 16 to 30 | Nitrogen solubility but detrimental to corrosion resistance in large concentrations |
| Molybdenum, Mo | 0 | 3.0** | 0 (heat-treating) | Corrosion resistance (if not present as carbides) |
| Silicon, Si | 0+ | 2.0 | 0.5 | Deoxidizer; reduces nitrogen solubility |
| Titanium, Ti<br>Niobium, Nb<br>Zirconium, Zr<br>Vanadium, V<br>Tungsten, W | 0+ | 3.0** | <0.4 (Nb) | Deoxidizers, carbide/nitride formers; also increase nitrogen solubility; grain refiners |
| Aluminum, Al and alkaline & alkaline-earth metals | 0+ | 0.5 | — | Deoxidizer but also nitride former |
| Iron, Fe | Balance | Balance | Balance | Ferrous alloy matrix |

**If absent, alloy should not require solution annealing heat treatment and rapid cooling to produce single-phase alloys.

Phosphorous (P) and sulfur (S) are important to avoid as best as possible. Both elements, when not combined to form sulfides or phosphides usually along grain boundaries are present as interstitials, thus competing with carbon (C) and nitrogen (N) and lowering the beneficial effects offered by these two elements. This results in reduction in the solid-solution strengthening and in the corrosion resistance.

Figure 2A:
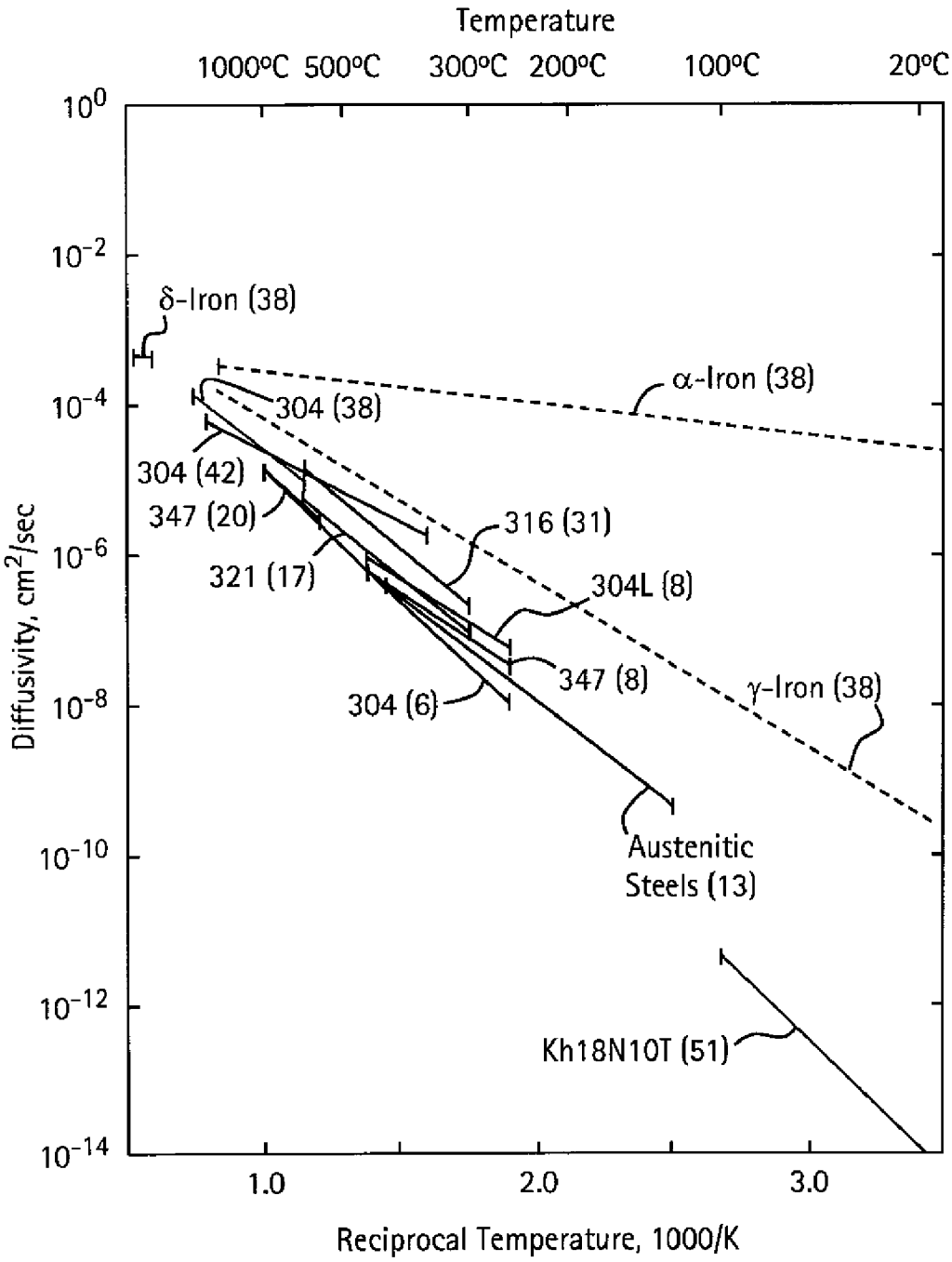
FIGS. 2A and 2B plot both the hydrogen (H) diffusivity and the hydrogen (H) permeability as a function of the reciprocal of the temperature; 1/T, where T is the temperature expressed in Kelvin (K). Major differences may be seen between the iron (Fe) equilibrium crystal structures; e.g. ferrite and austenite as well as several ferrous alloys.
Figure 2B:
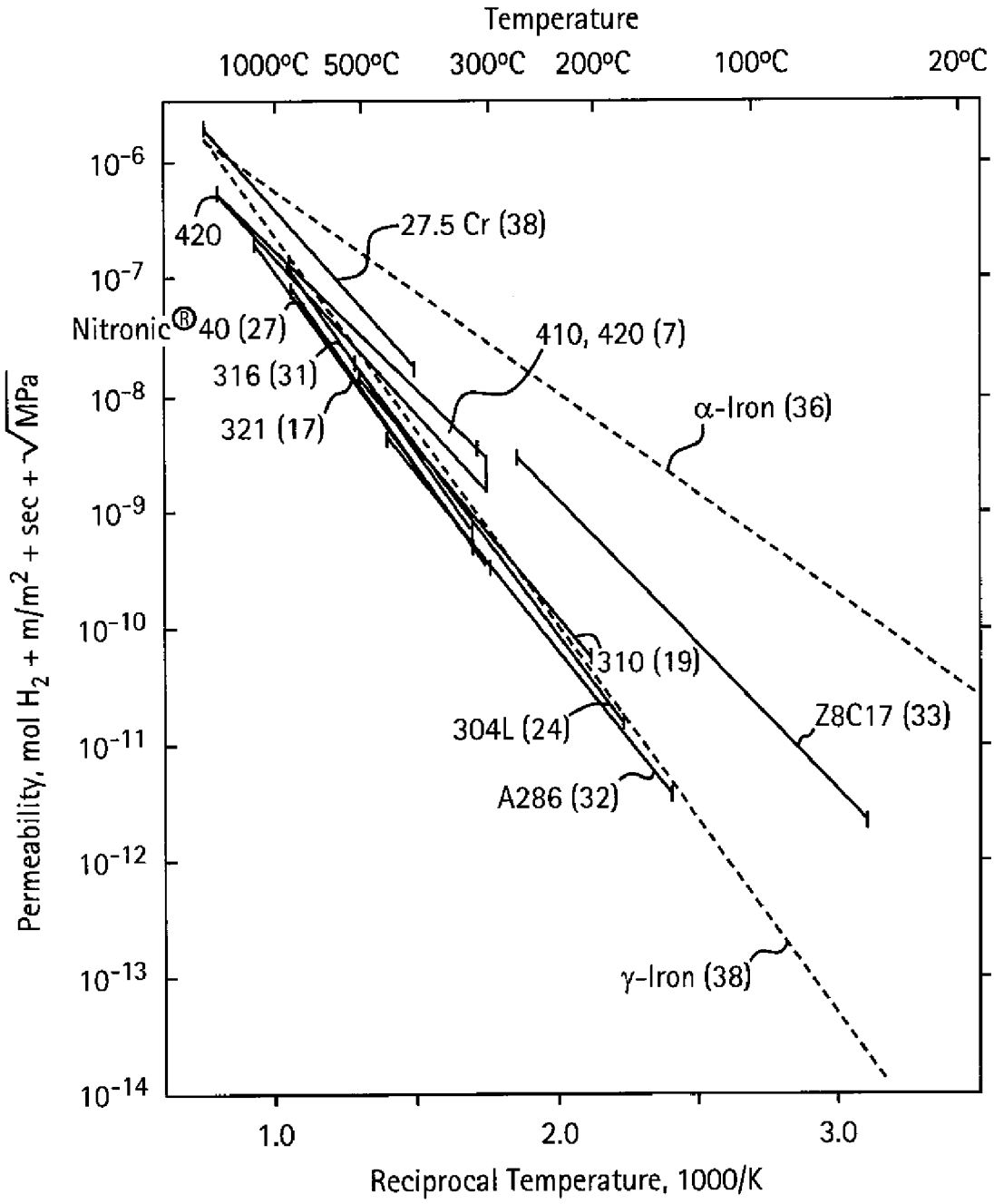
Figure 3:
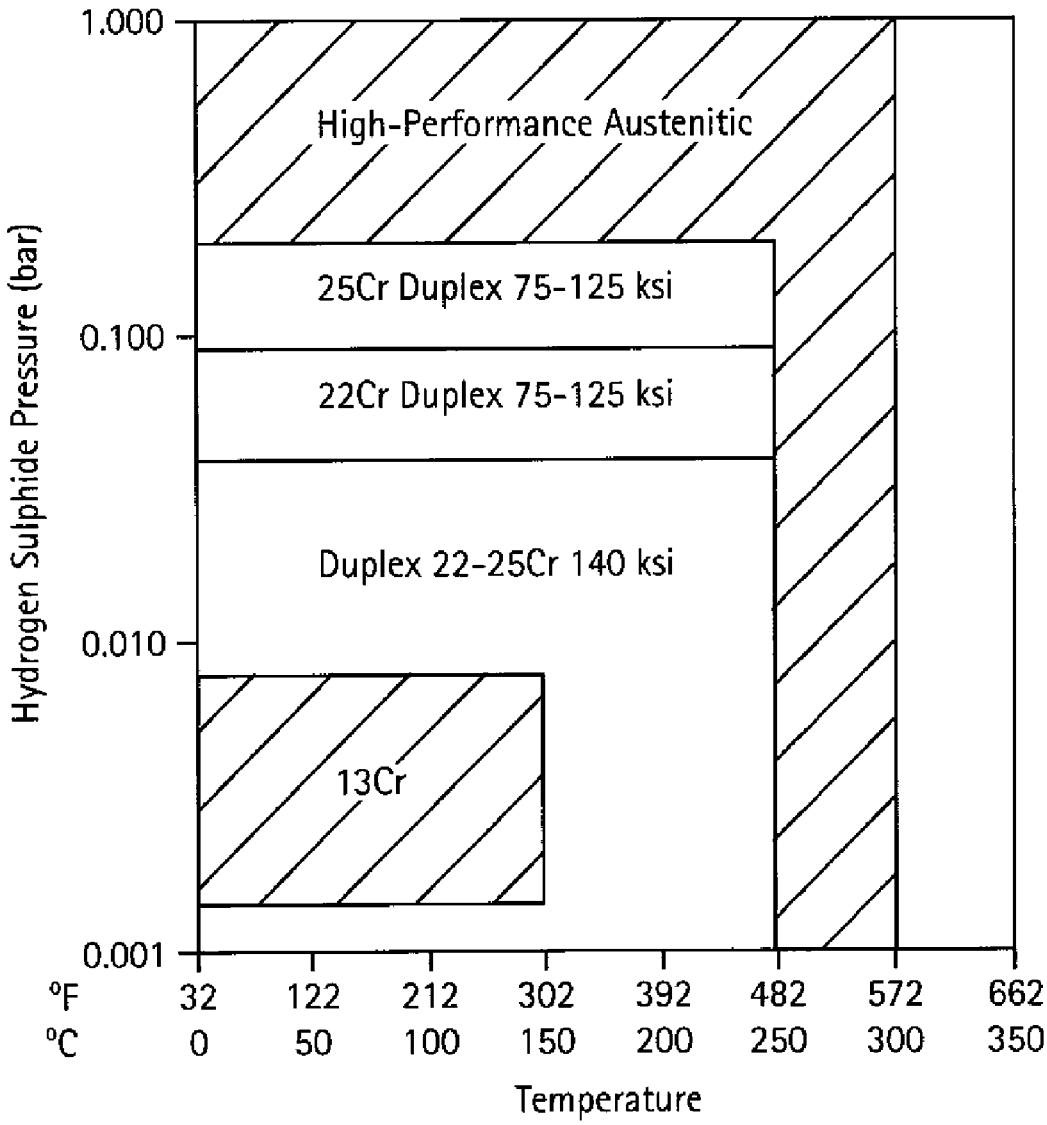
FIG. 3 is a two-dimensional map to compare various popular oil and gas alloys with respect to their susceptibility to fail in hydrogen sulfide ($H_2S$) environments. Note that the austenitic alloys out perform the other alloys; i.e. they may be used in hotter and more sour environments.

Resistance to service temperatures [e.g. ranging from about 250-500° F. (120-260° C.)], high pressures (greater than about 10 ksi; 1400 atm), and corrosive environments (e.g. completion fluids, brine; including chlorides) is of paramount importance for reliable and long-lasting equipments. Of particular concern for oilfield services is the resistance against hydrogen cracking in the presence of sulfides, or sulfide stress cracking (SSC). This form of damage is common in ferrous alloys with high strengths (e.g. >~800 MPa; 120 ksi); in particular the stronger the alloy, the lower its resistance to hydrogen damages (including SSC). A major parameter to control and reduce ferrous alloys susceptibility towards cracking in corrosive environments is by the development of appropriates microstructures. In other words, at constant chemical composition, various levels of immunity toward SCC exist depending upon alloy microstructure. For instance, the martensitic microstructures of low-alloyed and high-alloyed steels, including Maraging steels (i.e. precipitation strengthened stainless steels) are highly vulnerable to the various forms of hydrogen (H) damage, whereas the austenitic microstructures of steels (e.g. A286) or nickel alloys (e.g. 718, 725) are far less susceptible partly due to greater hydrogen (H) diffusivities and greater hydrogen (H) solubilities. FIGS. 2A and 2B show the variations with the reciprocal temperature (1/T) of the hydrogen (H) diffusivity and hydrogen (H) permeability of the ferrite phase (α), the austenite phase (γ), and a number of austenitic and martensitic steels. As general trend, with increasing temperature (i.e. decreasing reciprocal temperature), diffusivity and permeability both increase by orders of magnitude, as clearly indicated by the y-axis logarithmic scale. At room temperature, note that hydrogen (H) diffusivity is as much as 6 orders of magnitude greater in the ferrite (α) than in the austenite (γ), while the permeability is 3 orders of magnitude greater. Like the austenite in iron (γ), the austenitic alloys also possess far smaller diffusivities and permeabilities than ferritic and martensitic alloys; a characteristic that largely explains their SSC resistance. FIG. 3 shows an applicability map for oilfield alloys such as 13Cr martensitic steel, 25Cr duplex stainless steels and the austenitic steels (Kovach). It may be seen that the austenitic alloys withstand hydrogen sulfide ($H_2S$) environments better than the other cited alloys, or alloy families. Furthermore, FIG. 3 also shows that austenitic alloys may be employed at higher temperatures, because of their excellent resistance against general corrosion, as demonstrated by their high PRE and MARC numbers.

Like countless technical and scientific articles, a number of recent patent documents claim the beneficial effects of nitrogen (N) in austenitic steels, but rarely in relation with high carbon (C) additions and never for specific oil and gas applications. For instance, a patent by ALLVAC LTD describes non-magnetic corrosion resistant high strength steels for the drilling of oil and gas wells, but like the other patents restricts the nitrogen (N) to only 0.4 wt. %, proposes widely different and does not address carbon (C) effects. In U.S. Pat. No. 6,168,755, like in many other patents related to austenitic steels, carbon (C) is treated as an impurity, exactly like silicon (Si), oxygen (O), and sulfur (S) and their concentrations are restricted to 0.6 wt. % (Daido). In the Daido patent, carbon (C) is limited to 0.20 wt. % and nitrogen (N) to 1.5 wt. %. To the authors best knowledge, in prior art the deliberate use of both carbon (C) and nitrogen (N) in alloys for the oilfields, specifically designed to improve resistance in corrosive (and sour) environments is unknown.

Figure 4:
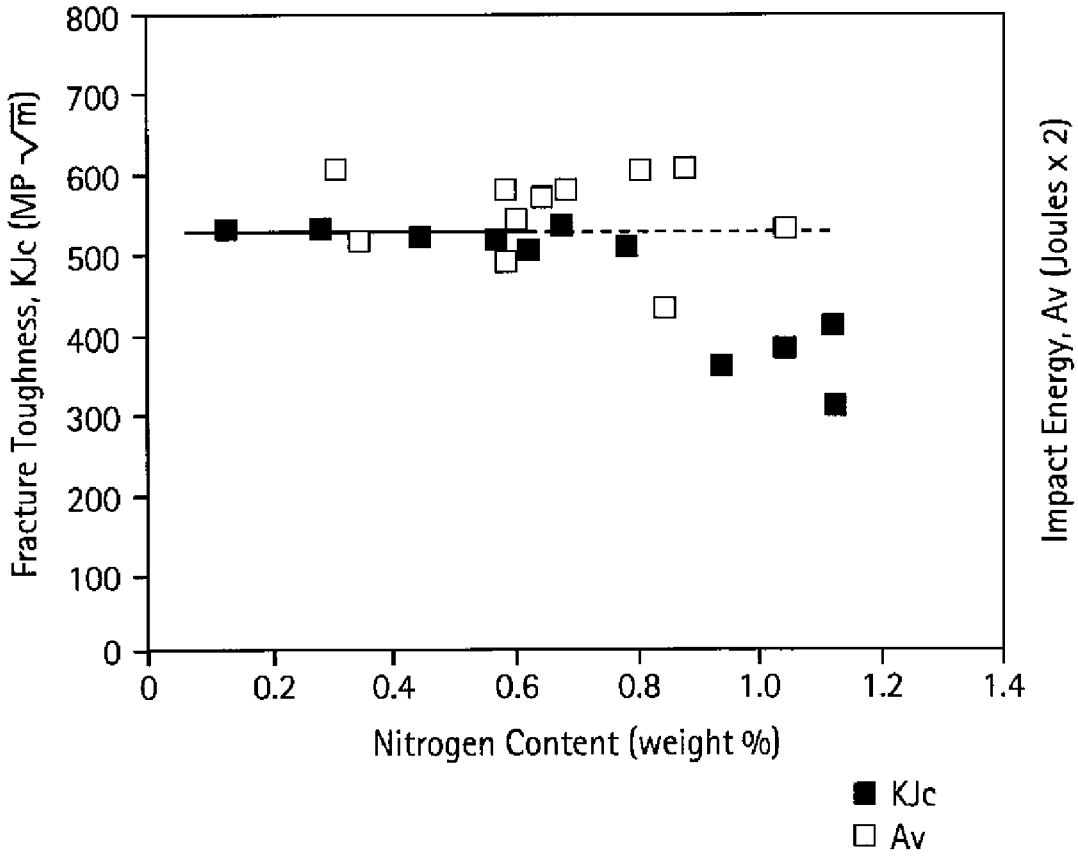
FIG. 4 shows that nitrogen (N) has no noticeable effect on alloy toughness as impact energy remains far greater than 100 J (70 ft.lb); the minimum needed by our foreseen applications being typically 40 J (30 ft. lb).

Of considerable interest for downhole completion tools, wherein the environment is sour, carbon (C) and nitrogen (N) also strengthen the equilibrium phases of iron (Fe) to the greatest extents, mainly through interstitial solid solutions whereas ductility (elongation) and toughness are affected with negligible consequences. FIG. 4 is a graphical representation borrowed from the literature showing that nitrogen (N) in interstitial sites does not affect the alloy toughness noticeably. As long as the microstructure remains austenitic (γ), toughness remains in excess of what is normally demanded by oilfield applications (greater than about 40 J; 30 ft-lb).

The strengthening induced by interstitial nitrogen (N) and carbon (C) may be depicted by the predictive yield strength (YS) and tensile strength formulas (TS) given by Irvine (see Kamachi), and listed as Equations 1 and 2. Though these equations were not developed for the carbon (C) and nitrogen (N) contents described in the present invention, they well illustrate the contribution of both alloying elements when these two elements are used independently (i.e. one at a time) and free of mutual interactions:

$$YS(MPa) = \left\{ \begin{array}{c} 63.5 + 469(wt.\%N) + 356.5(wt.\%C) + \\ 20.1(wt.\%Si) + 3.7(Wt.\%Cr) + 14.6(wt.\%Mo) + \\ 18.6(wt.\%V) + 4.5(wt.\%Nb) + 40.3(wt.\%Nb) + \\ 26.3(wt.\%Ti) + 12.7(wt.\%Al) + 2.5(wt.\%_) + 7.1d^{-0.5} \end{array} \right\} \quad (1)$$

$$TS(MPa) = \left\{ \begin{array}{c} 449.5 + 852.5(wt.\%N) + 542.5(wt.\%C) + \\ 7.2(wt.\%Si) - 1.57(Wt.\%Ni) + 18.6(wt.\%Mo) + \\ 77.5(wt.\%Nb) + 46.5(wt.\%Ti) + 18.6(wt.\%Al) + \\ 2.2(wt.\%) + 7.1t^{-0.5} \end{array} \right\} \quad (2)$$

In Equations 1 and 2, d is the average grain size in μm, t is the average density of twins per mm. As shown by Equations 1 and 2, nitrogen (N) and carbon (C) raise the yield strength (YS) and the tensile strength (TS) more than other substitutional solid solution elements; e.g. silicon (Si), chromium (Cr), niobium (Nb), etc.

Although Equations 1 and 2 describe both carbon (C) and nitrogen (N) contributions to interstitial solid-solution strengthening, carbon (C) and nitrogen (N) are usually present in prior known alloys with only one content being high and the other being extremely low; e.g. 0.01 wt. % carbon (C), 0.5 wt. % nitrogen (N) (see various patents referred to herein to Daido, Saller et al. (Bohler), U.S. Pat. No. 6,168,755 B1, (Biancaniello, et al.), and ALLVAC LTD). Unique to the ferrous alloys of the present invention is the application of alloy addition of both carbon (C) and nitrogen (N) in excess of approximately 0.4 wt % for alloys intended for oil and gas applications. Unless desired, in these innovative alloys, carbon (C) and nitrogen (N) remain in interstitial sites with no or no consequential presence of carbides, nitrides, carbon-nitrides and other precipitates. The explanation for the absence for instance of carbides and nitrides in the austenite (γ) is due to the ordering of carbon (C) and nitrogen (N) in the interstitial positions of the austenite (γ) FCC lattice (see Rawers and Gavriljuk). The ordering results in the inability of carbon (C) and/or nitrogen (CN) to cluster in sizes larger than the critical size for nucleation and growth of carbide and nitride precipitates. Equal and nearly-equal contents of carbon (C) and nitrogen (N) in ferrous alloys have been shown to guarantee the absence of carbides and nitrides. From Equations 1 and 2, it is apparent that nitrogen (N) enhances strength more than carbon (C) for the same contents. To guarantee yield strengths beyond 800 MPa (~120 ksi), a minimum of about 1.0 wt. % of each is needed.

Figure 5:
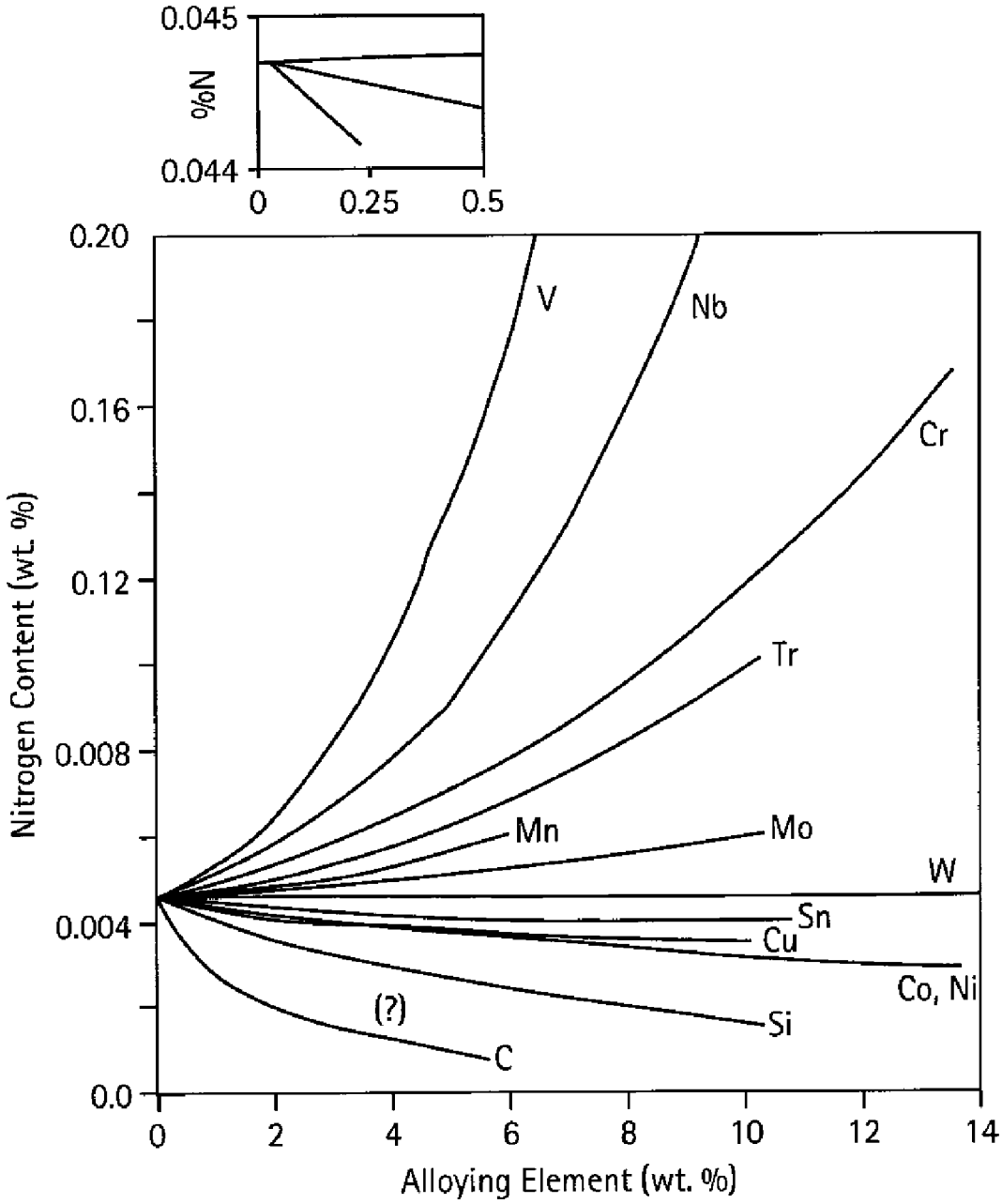
FIG. 5 demonstrates the effects of a number of common alloying elements on the solubility of nitrogen (N) in iron (Fe) at one atmosphere (0.1 MPa). Note that solubility is low in pure iron (Fe), and that it is smallest in ferrite ($\alpha$, $\delta$), a phase that must therefore be suppressed in the inventive alloys when solidification occurs.

For proper corrosion resistance, including sulfide stress cracking (SSC) resistance, embodiments of the ferrous alloys of the present invention comprise over 12 wt. % chromium (Cr). FIG. 5 shows how several alloying elements affects the nitrogen (N) solubility in liquid iron (Fe). Clearly, chromium (Cr) contributes to major extents by increasing nitrogen (N) solubility in the alloy, as are molybdenum (Mo), manganese (Mn), niobium (Nb) and vanadium (V); however, because molybdenum (Mo), niobium (Nb), and vanadium (V) are also strong carbide formers in stainless alloys, their use is limited unless carbon-rich phases are desired, as for wear resistance for instance. While FIG. 6 indicates that nitrogen (N) solubility decreases as iron (Fe) solidifies, FIG. 7 reveals the positive role of chromium (Cr) on nitrogen (N) solubility, even in the solid phases; i.e. ferrite ($\alpha$ and $\delta$) and austenite ($\gamma$). As chromium (Cr) content increases, nitrogen (N) solubility in both the liquid and solid phases increase dramatically.

Resistance to pitting and corrosion is well summarized by the PRE (Pitting Resistant Equivalence) and MARC (measure of Alloying for Resistance to Corrosion) numbers defined in Equations 3a, 3b and 4 (see Jargelius-Pettersson, Kamachi). These additive formulas indicate that both carbon (C) and nitrogen (C) are highly beneficial to improve corrosion resistance, but only as long as nitrogen (N) and carbon (C) phases (e.g. carbides, nitrides) are not extensively produced. These equations are empirical; depending upon the alloys chosen for study, coefficients for each alloying element may vary. Of the two PRE equations, Equation 3a is well-accepted and listed in the NACE MR017/ISO 15156 standards, whereas Equation 3b has been specifically developed for high nitrogen steels (see Jargelius-Pettersen). The austenitic alloys of the present invention are all characterized by PRE (Pitting Resistance Equivalence) numbers (Eq. 3b) between about 20 and 44 and MARC (Measure of Alloying for Corrosion resistance) numbers between about 30 and 60 in the absence of molybdenum (Mo); a considerable improvement over existing commercial alloys (See Table 1 and 2). Though carbon (C) is detrimental to corrosion when it produces carbides, the supersaturation of the austenite ($\gamma$) with the prescribed carbon-plus-nitrogen contents tend to prevent carbides from forming and thus helps to achieve a high corrosion resistance. Manganese (Mn) and nickel (Ni) reduce slightly corrosion resistance, as indicated by Equation 4; however their effects are largely offset by that of nitrogen (N) and carbon (C) in solid solution.

$$\text{PRE}=\text{wt. \% Cr}+3.3\ \text{wt. \% Mo}+16\ \text{wt. \% N} \tag{3a}$$

$$\text{PRE}=\text{wt. \% Cr}+3.3\ \text{wt. \% Mo}+37\ \text{wt. \% N}+4.5(\text{wt. \% Mo})(\text{wt. \% N}) \tag{3b}$$

$$\text{MARC}=\text{wt. \% Cr}+3.3\ \text{wt. \% Mo}+20\ \text{wt. \% C}+20\ \text{wt. \% N}-0.5\ \text{wt. \% Mn}-0.25\ \text{wt. \%/Ni} \tag{4}$$

Figure 6:
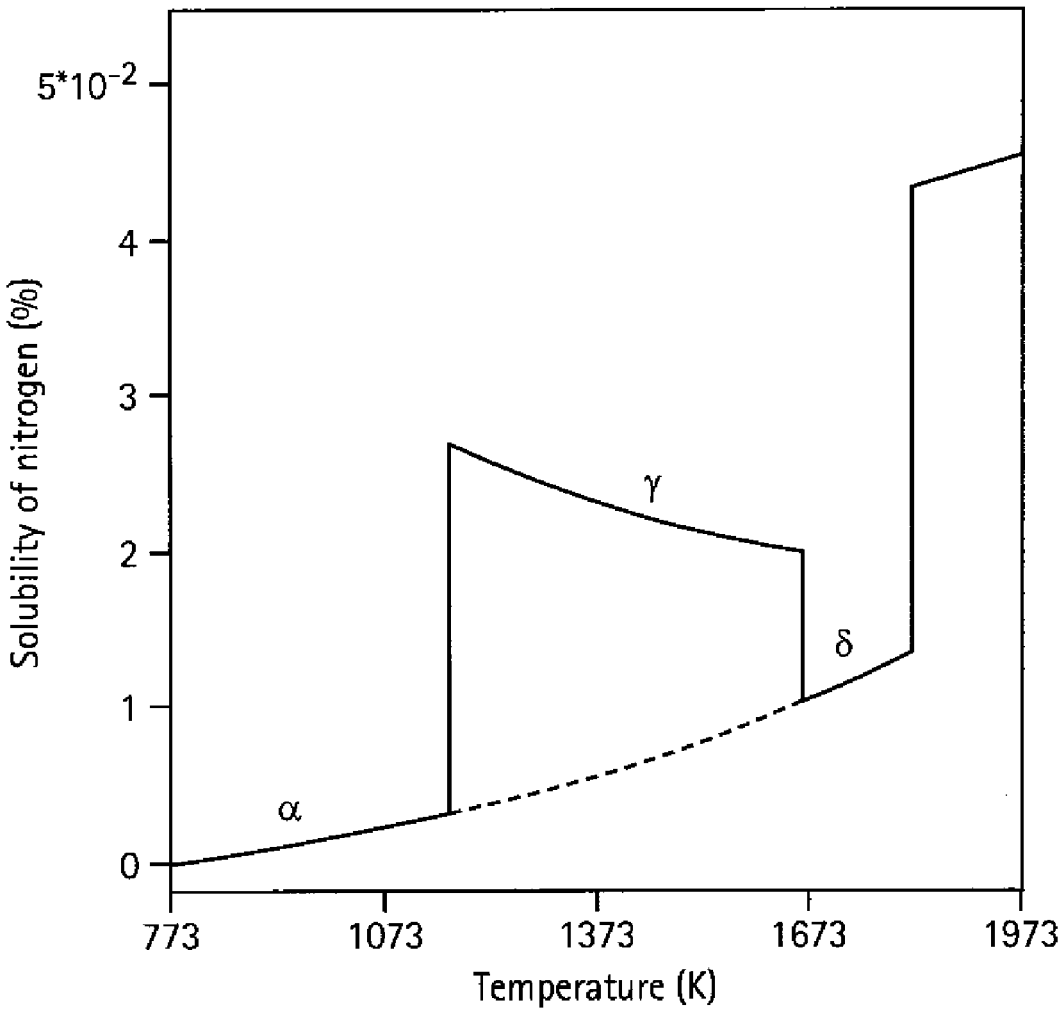
FIG. 6 shows the variation of nitrogen (N) solubility at 1 atm (0.1 MPa) in the various equilibrium phases of iron (i.e. ferrite, austenite) between 773K to 1973K.
Figure 7:
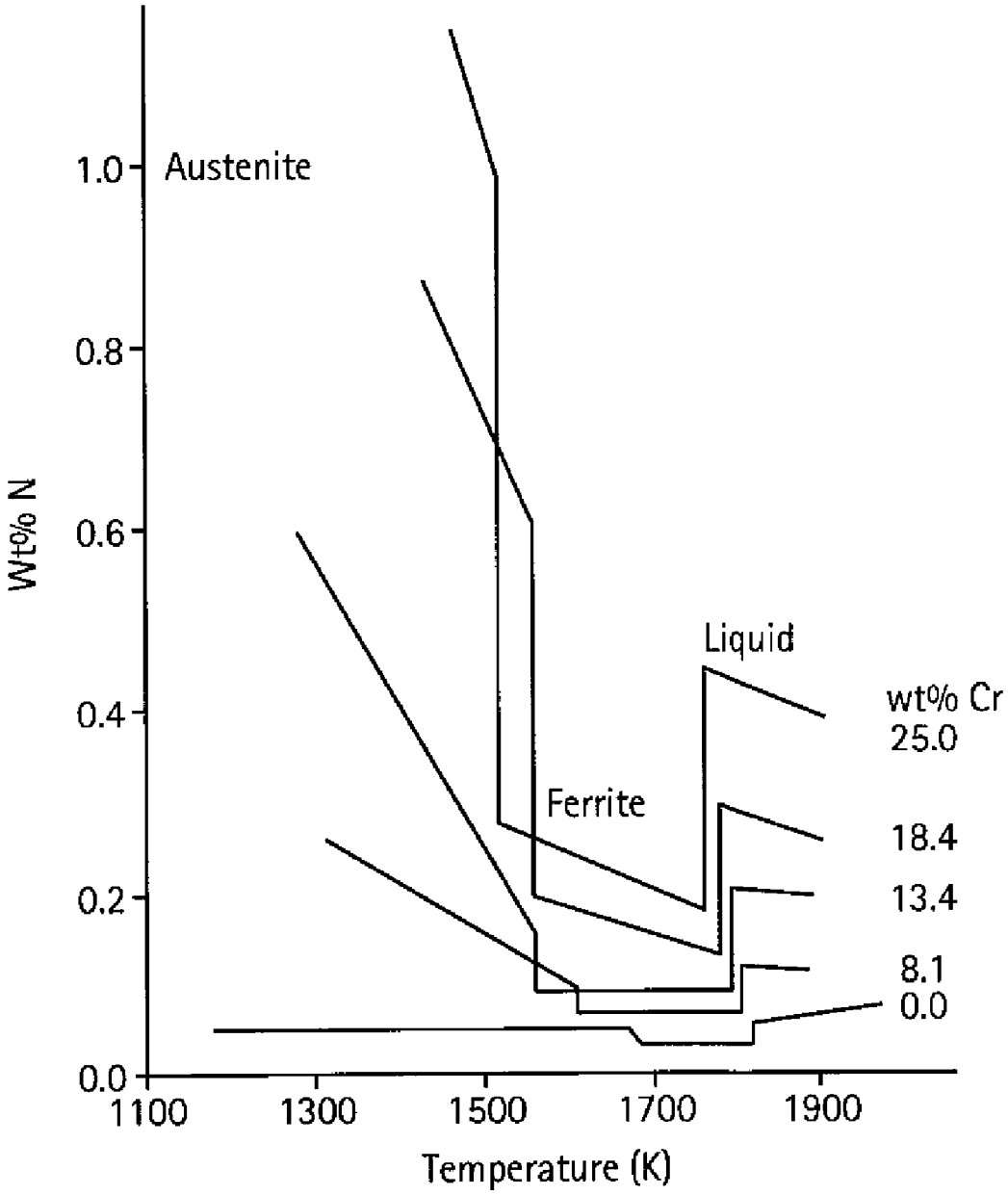
FIG. 7 is comparable to FIG. 6 and demonstrates the effect of chromium (Cr) on nitrogen (N) solubility at 1 atm (0.1 MPa) in the various equilibrium phases.

Alloying elements in ferrous alloys of the invention were selected so that the liquid of the resulting alloy may hold high concentrations in nitrogen (N) and it solidifies, solidifies only with an austenite phase ($\gamma$) that is even more soluble in nitrogen (N), so that the as-solidified product remain essentially void-free. For pure iron (Fe), FIG. 6 showed that nitrogen (N) solubility is extremely low. Equally important, it is seen that nitrogen (N) solubility is greatest in the liquid, then rapidly decreases as iron solidifies into ferrite ($\alpha$), and increases once more once iron transforms in austenite ($\gamma$). Further, it is seen that nitrogen (N) solubility in the austenite ($\gamma$) increases with decreasing temperature; a characteristics that is not seen in the low-temperature ferrite ($\alpha$). FIG. 7 showed that chromium (Cr) increases dramatically both solubility in the liquid and the austenite ($\gamma$). When not heated far beyond its melting temperature (i.e. superheated to great extents), the liquid phase of Fe—Cr (FIG. 7) alloys may hold up to 0.45 wt. % nitrogen (N), while the austenite ($\gamma$) may exceed 1.0 wt. %. Being a strong austenite ($\gamma$) stabilizer, the addition of manganese (Mn) prevents solidification to proceed with the ferrite ($\delta$) phase; a characteristics that prevents porosity by guaranteeing the austenite ($\gamma$) has even more solubility for nitrogen (N) than the alloy liquid phase.

Ferrous alloys of the invention comprise from about 0 to about 3 wt. % molybdenum (Mo). The positive contribution of molybdenum (Mo) to corrosion resistance is clearly illustrated by Equations 3a, 3b and 4. Additions from 0 up to 3.0 wt. % are proposed to improve corrosion resistance, including sulfide stress cracking resistance (SSC). However, if molybdenum is found to form carbides or other intermetallic phases, high-temperature annealing (solutionizing) following by a rapid cooling should be conducted. Such heat-treatment may be required after casting (post-casting heat treatment).

Despite cost of nickel (Ni) and the fact it is known to reduce nitrogen (N) solubility, it remains desirable to have some nickel (Ni) to ensure repassivation and assist in minimizing SSC. Due to the strong effects of nitrogen (N) and carbon (C) and the high cost of nickel (Ni), nickel (Ni) may be reduced below 4 wt. %, whereas in conventional austenitic stainless steel nickel (Ni) typically exceeds 8 wt. % to insure a fully austenitic microstructure. In the inventive ferrous alloys, nitrogen (N) also acts as a substitute to large amounts of nickel (Ni); thus providing the inventive alloys low-raw material costs. In the inventive alloys, cobalt (Co) may be used as partial substitute of nickel (Ni); cobalt (Co) also improves corrosion resistance.

Manganese (Mn) is present up to about 30 wt. %. Manganese (Mn) is essential to guarantee austenite ($\gamma$) stability, enhance nitrogen (N) solubility (thus increase corrosion resistance and strength), and promote alloy sulfide control to improve castability.

Vanadium (V), niobium (Nb), zirconium (Zr), titanium (Ti), tungsten (W) also have a grain-refining effect and can be present individually or in any combination with a total usually not greater than 0.4 wt. %. Vanadium (V), niobium (Nb), titanium (Ti), molybdenum (Mo), tungsten (W), like manganese (Mn) and chromium (Cr) make a positive contribution to the solubility of nitrogen (N). This is illustrated in FIG. 5 for the nitrogen (N) solubility in liquid iron (Fe); likewise nitrogen (N) solubility in austenite ($\gamma$) is increased. These alloy elements also improve corrosion resistance and resistance against sulfide stress cracking (SSC).

Like silicon (Si), aluminum (Al) contributes to deoxidizing the alloys but is also a potential hard-phase former. Therefore, aluminum like other alkaline-earth metal elements should not be present in substantial contents, up to about 0.5 wt. % total. Deoxidation is important to insure carbon (C) and nitrogen (N) solubility in austenite ($\gamma$) are maximized.

Impurities such as sulfur (S), phosphorous (P), tin (Sn), lead (Pb) must be as low as possible to avoid solidification cracking during casting or welding. These elements also reduce the concentrations of nitrogen (N) that can be stored in austenite ($\gamma$).

The ferrous alloys of the invention may be homogenized after melting (casting). Melting is preferentially but not necessarily conducted in a nitrogen-rich atmosphere to enable sufficient nitrogen (N) absorption. Nitrogen (N) enrichment may be achieved through metal nitride powder alloying (e.g. $Cr_2N$ powder). Cooling in a nitrogen-controlled environment, or rapid cooling to prevent nitrogen (N) degassing from the liquid alloy may be employed, or both. If dictated by the applications, homogenization and forging at temperature higher than about 1050° C. (1950° F.) into near-net shapes followed by recrystallization into finer grain austenite (γ) may be conducted.

The inventive alloys may be readily cast, and in theory fusion welded with minimum nitrogen (N) losses because of their austenitic microstructures and the fact fusion welding normally involves very high solidification and cooling rates.

An important aspect of the invention are well completions comprising one or more ferrous alloys of the invention. As used herein the terms "well completion" and "completion" are used as nouns except when referring to a completion operation. Well completion within the invention include, but are nor limited to, casing completions, commingled completions, coiled tubing completions, dual completions, high temperature completions, high pressure completions, high temperature, high pressure completions, multiple completions, natural completions, artificial lift completions, partial completions, primary completions, tubingless completions, and the like.

Furthermore, one or more primary completion components may be comprised of one or more ferrous alloys of the invention. As used herein the phrase "primary completion components" includes, but is not limited to, the main elements of an oil or gas well, including the production tubing string, that enable a particular type or design of completion to function as designed. The primary completion components depend largely on the completion type, such as the pump and motor assemblies in an electrical submersible pump completion. A non-exhaustive list of completion accessories which may comprise one or more ferrous alloys of the invention exposed to downhole conditions during their use is provided in Table 4.

TABLE 4

| Completion accessories that may be comprised of one or more ferrous alloys of the invention* |
|---|
| Bridge Plugs |
| Wireline Set |
| PosiSet Thru-Tubing Plug |
| CPST Pressure Setting Tool |
| Flow Control Equipment |
| Locks |
| A-Slip Lock |
| A-Series Tubing Stop |
| Z-5 Collar Lock |
| C-Series Top No-Go Lock |
| CBNS-R Bottom No-Go Lock |
| HPC-R High-Pressure Top No-Go Lock |
| DB-6-Series Top No-Go Lock |
| DB-6-E Top No-Go Lock |
| DB-6-HP-Series Top No-Go Lock |
| Blanking Plugs and Standing Valves |
| C-Series Circulating Plug |
| A-Series Blanking Plug |
| HP-A Blanking Plug |
| A-2- and M-Series Equalizing Standing Valves |
| HP-SV Equalizing Standing Valve |
| DB-1-WLP Blanking Plug |
| DB-P Blanking Plug |
| DB-HP Blanking Plug |

TABLE 4-continued

| Completion accessories that may be comprised of one or more ferrous alloys of the invention* |
|---|
| Accessories |
| A-2 Shock Absorber |
| Upper and Lower Tubing Packoffs |
| Sliding Sleeve Separation Tool |
| Sliding Sleeve Packoff |
| Tubing Mounted Completion Accessories |
| Lasalle Protectors |
| Nipples |
| A-Seating Nipple |
| D-Series No-Go Landing Nipple |
| D-15 No-Go Landing Nipple |
| CAMXN Bottom No-Go Landing Nipple |
| CAMX Selective Landing Nipple |
| DB No-Go Landing Nipple |
| DB-HP Top No-Go Landing Nipple |
| Expansion Joints |
| Model C Expansion Joint |
| Model D Expansion Joint |
| TES Splined Expansion Joint |
| OEJ Overshot Expansion Joint |
| OP One-Piece Expansion Joint |
| Retrieving Heads for OEJ and OP Expansion Joints |
| TEJS Expansion Joint |
| Type-A Swivel Slip Joint |
| Polished Bore Receptacle and Seal Assembly |
| PBR Retrieving Tool |
| Adjustable Unions |
| AUT-1 Adjustable Union |
| Model A Adjustable Joint |
| Temporary Tubing Plugs |
| Model A and Model B Tubing Shear Plugs |
| Model A and Model B Pumpout Plugs |
| CR-1 Pump-Through Sub |
| PE-500 Pumpout Plug |
| Model A Hydro-Trip Sub |
| Sliding Sleeves |
| CS-1-Series Sliding Sleeve |
| CS-3-Series Nonelastomeric Sliding Sleeve |
| Safety Joints |
| QUANTUM Long-Stroke Safety Shear Sub |
| Tubing Tension Safety Joint |
| Type-A Rotation-Release Safety Joint |
| Chemical Injection Nipples |
| HPCI-DC High-Pressure Chemical Injection Mandrel |
| DCIN Dual-Check Chemical Injection Mandrel |
| On-Off Attachments |
| TSR Tubing Separation Tool |
| LJ-1 On-Off Attachment |
| Model SL On-Off Unit |
| Tubular Accessories |
| Wireline Reentry Guide |
| Flow Coupling and Blast Joint |
| Perforated Production Tube |

*All trademarks are used and owned by Schlumberger

Well completions and primary completion components are frequently required to withstand extremely corrosive conditions at high temperatures and pressures, such as given in Table 5.

TABLE 5

| Representative example of well conditions in which a well completion might operate | |
|---|---|
| Bottom hole P | 900-1200 Bar (13,050-17,400 psi) |
| Bottom hole T | 169° C. (336° F.) |
| $H_2S$ content or partial pressure | 20-50 ppm (0.26-0.88 psi) |
| $CO_2$ concentration | 3.4-4.5% (448-594 PSIA) |
| $Cl^-$ concentration | 56,600 mg/l |
| $HCO_3$ concentration | 857 mg/l |
| HAc concentration | 100 mg/l |

TABLE 5-continued

| Representative example of well conditions in which a well completion might operate | |
|---|---|
| Well Fluid | Gas Condensate |
| Hg concentration | 0.15-7 mg/m$^3$ |
| Production Rate | 2.5 mmscmd (89 mmscfd) |
| Scale | Yes |
| Methanol | Injected |

FIGS. 8-10 illustrate oilfield tubular products that may comprise several components, any or all of which may comprise one or more ferrous alloys of the invention. Any metallic part in a well completion can be made of the inventive alloys and that includes all the components discussed and/or illustrated in FIGS. 8-10. FIG. 8A is a schematic side elevation view, partially in cross-section, and not necessarily to scale, of a casing completion 10 in a formation 2, a configuration in which a production casing string is set across a reservoir interval and perforated to allow communication between the formation and wellbore. Casing completion 10 includes a conductor pipe 12, a surface casing 14, an intermediate casing 16, and a production casing 18 having a perforated interval 20. The casing performs several functions, including supporting the surrounding formation under production conditions, enabling control of fluid production through selective perforation, and allowing subsequent or remedial isolation by packers, plugs or special treatments. The casing is placed down the wellbore from the surface to separate the open hole from the formation, prevent the wellbore from caving in allow the flow of fluids both in and out of the wellbore. The size of the casing depends on the depth of the well, the size of the open hole, the drilling objective, the expected hydrostatic and formation pressures, the type of completion once the well is drilled. Of these, the hydrostatic and formation pressures are the most important to avoid bursting or collapsing of casing. The materials for such applications must therefore be of high-strength, and because the environment is also corrosive and often sour, corrosion resistance (include sulfide stress cracking) is important. Prior to the present invention, the various casing components have employed 13Cr martensitic alloys (<100 ksi) and nickel alloys (<140 ksi; e.g. alloy 718) in sour environments. The inventive alloys could act at least as partial substitute to these alloys. Alloy 718 is very expensive, as noted in FIG. 1.

FIG. 8B illustrates another well completion 30, some or all of the components of which may benefit from being comprised of one or more alloys of the invention. Well completion 30 comprises a gravel-pack packer 32, first and second FIV's or formation isolation valves 34, 36, and a sump packer 38. FIV's protect formations from damage by fluid loss during completions and workover operations. Standard versions may be equipped with a module known under the trade designation "Trip Saver", available from Schlumberger, to open the valve one time using pressure cycles. One version of FIV, known under the trade designation "FIV HPHT", also available from Schlumberger, is a high-pressure, high-temperature (HPHT) valve qualified for 17,500-psi[120 MPa] burst pressure and 15,000-psi[103 MPa] differential pressure across the ball while operating in high-temperature (about 425° F. [218° C.] or more) environments. By isolating the formation within the lower completion from damaging fluids, an FIV valve enhances production, simplifies completion operations, and increases wellbore safety especially during multiple perforating runs. While FIV valves are of robust construction normally, using one or more of the inventive ferrous alloys may provide for more reliable and extended service. With its ability to hold pressures from above and below, the fit-for-purpose engineered FIV system has become a key component in well completions such as intelligent and multiple-zone completions. In addition, FIV systems may act as a downhole lubricator valve so that long strings of service equipment can be run and retrieved while the formation is completely isolated. FIV systems also provide a two-way barrier for electrical submersible pump (ESP) workovers, underbalanced drilling, or other completion operations. FIV systems employing one or more ferrous alloys of the invention may be employed for safety reasons, for example, to suspend or temporarily abandon a well. FIV valves have a high differential rating compared to a flapper-type, fluid-loss device, and may be opened with tubing pressure, eliminating a trip in the well. When the shifting tool is pulled through the FIV tool, the ball closes and the shifting tool unlatches from the shifting collet for retrieval. In operation, an FIV valve is a fully open, mechanical ball valve. The sealing ball design may be a larger version of the field-proven Schlumberger drillstem test valve known under the trade designation (DST) HPHT ball valve with a gas-tight seal. This proven technology helps isolate a formation from the wellbore.

FIGS. 8C1-8C5 illustrate various completion elements found in a typical well completion. Any or all of the elements may comprise one or more ferrous alloys within the present invention. FIG. 8C1 illustrates a side elevation view, partially in cross section, of a well completion 50 in accordance with the invention, having a safety valve 52, nipple 54, side pocket mandrel 56, production packer 58, a tubing-retrievable flow controller 60, hydraulic or electrical (TRFC-H or TRFC-E), a sand screen 62, and a sump packer 64. In some completions, in order to reduce the number of well runs, the tubing-retrievable flow controller and sand screen maybe combined or packaged into a single unit. In certain completions, wireline-retrievable flow controllers may be used, and, while not discussed herein in detail, may have one or more components comprising one or more ferrous alloys of the invention. Tubing-retrievable flow controllers, including those available from Schlumberger, may be used to optimize reservoir production by adjusting the flow rate between the reservoir and the tubing by creating a pressure drop through a set of calibrated orifices, which may be comprised of one or more ferrous alloys of the invention. Flow is regulated by changing the position of a choke sleeve, controlled by a hydraulic actuator. The choke sleeve and components of the hydraulic actuator may also be comprised of one or more ferrous alloys of the invention. The position of the choke controls flow in a range from zero (shut-in) up to, for example, 70,000 b/d[11, 130 m/$^3$ day]. A distributor device allows the operator to select the direction the sleeve moves based on pressure pulses sent down a single hydraulic control line. This means that the sleeve can instantly reverse direction without the need to cycle through all choke positions. A typical TRFC-H may be rated at 10,000 psi[69 MPa] differential pressure for sour service, and fits a 5.5-in[14 cm] tubing in a 9.625-in[24.4 cm] casing string. Applications include production optimization in horizontal wells by choking the upper sections of the wellbore; reduction of gas or water coning in a segment between two packers; use of a gas zone for artificial lift production; shut-in a zone for testing or to close off water production; and elimination of the need for downhole intervention, because the devices are surface controllable. The latter feature makes the TRFC-H ideal for subsea wells.

FIG. 8C2 is a larger schematic side elevation view, partially in cross section, of safety valve 52, illustrating components that may be comprised of one or more ferrous alloy of the invention, such as valve body 53, hydraulic control line to surface 66 which feeds a compartment 68, control sleeve 70, 72, flapper 74, threads 76, 78, and fail-safe spring 80. FIG. 8C3 illustrates a perspective view of flapper 74 in its open position, perhaps better viewed in reference to FIGS. 8C4 and 8C5, which illustrate open and closed positions, respectively, of safety valve 52. Safety valves are commonly known as subsurface safety valves (SSSV), a safety device installed in the upper wellbore to provide emergency closure of the producing conduits in the event of an emergency. Two types of subsurface safety valve are available: surface-controlled and subsurface controlled. In each case, the safety-valve system is designed to be fail-safe, so that the wellbore is isolated in the event of any system failure or damage to the surface production-control facilities. A surface-controlled subsurface safety valve (SCSSV) is a downhole safety valve that is operated from surface facilities through a control line strapped to the external surface of the production tubing. Two basic types of SCSSV are common: wireline retrievable, whereby the principal safety-valve components can be run and retrieved on slickline, and tubing retrievable, in which the entire safety-valve assembly is installed with the tubing string. The control system operates in a fail-safe mode, with hydraulic control pressure used to hold open a ball or flapper assembly that will close if the control pressure is lost. A subsurface surface-controlled safety valve (SSCSV) is also a downhole safety valve designed to close automatically in an emergency situation. There are two basic operating mechanisms: valves operated by an increase in fluid flow and valves operated by a decrease in ambient pressure. Given the difficulties in testing or confirming the efficiency of these valves, surface-controlled safety valves are much more common.

FIG. 9 is a schematic perspective view, with some parts broken away, of another completion apparatus 100 used in gas lift operations, which may have some or all of its components comprised of an alloy of the invention, including casing 12, production tubing 18, side-pocket mandrel with gas lift valve 56, packer 112 and tail pipe assembly 114. Gas bubbles are indicated at 110 after being introduced into the producing fluid through the mandrel. Gas lift is an artificial-lift method in which gas is injected into the production tubing to reduce the hydrostatic pressure of the fluid column. The resulting reduction in bottomhole pressure allows the reservoir liquids to enter the wellbore at a higher flow rate. The injection gas is typically conveyed down the tubing-casing annulus and enters the production train through a series of gas-lift valves. The gas-lift valve position, operating pressures and gas injection rate are determined by specific well conditions.

Figure 10A:
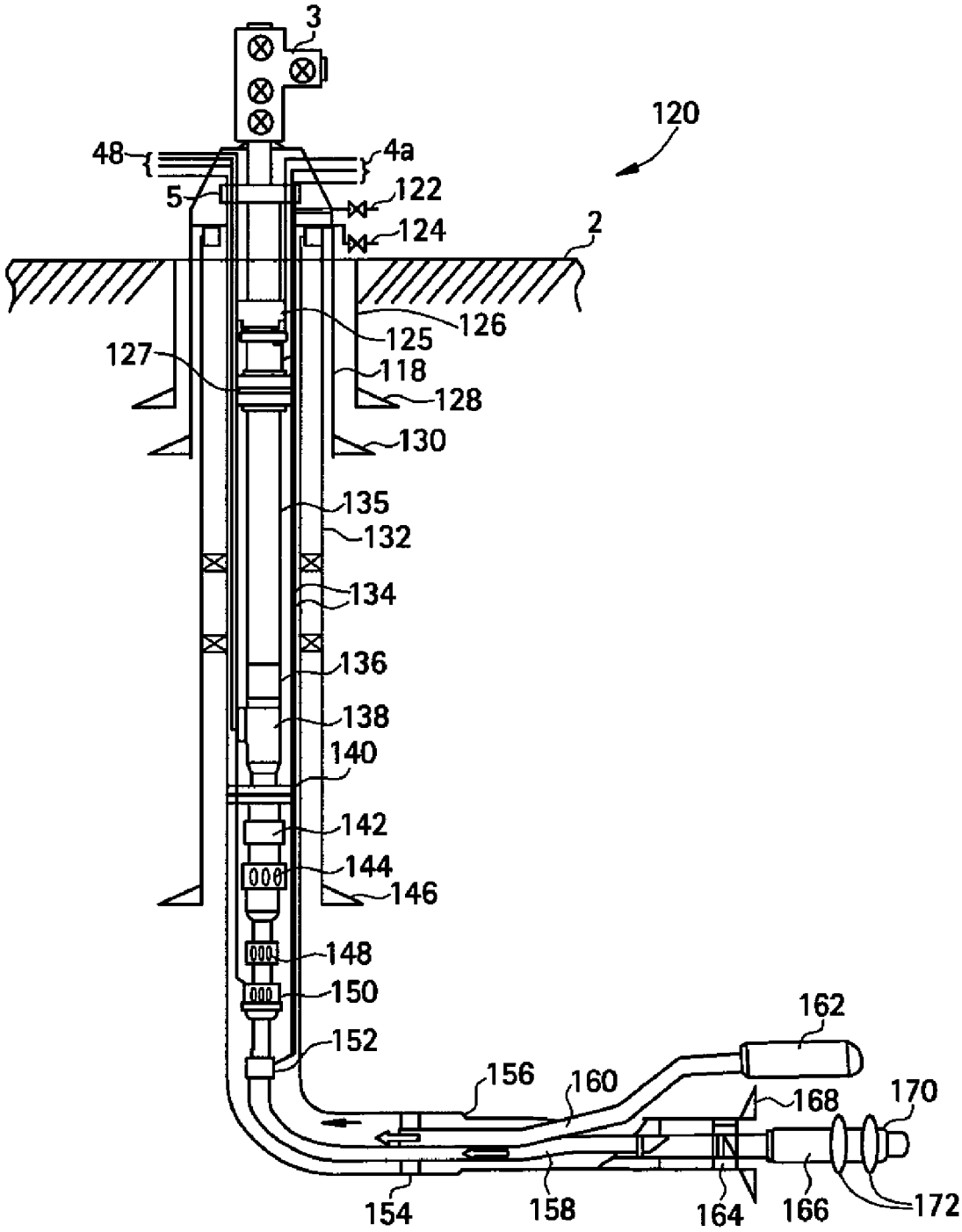
Figure 10B:
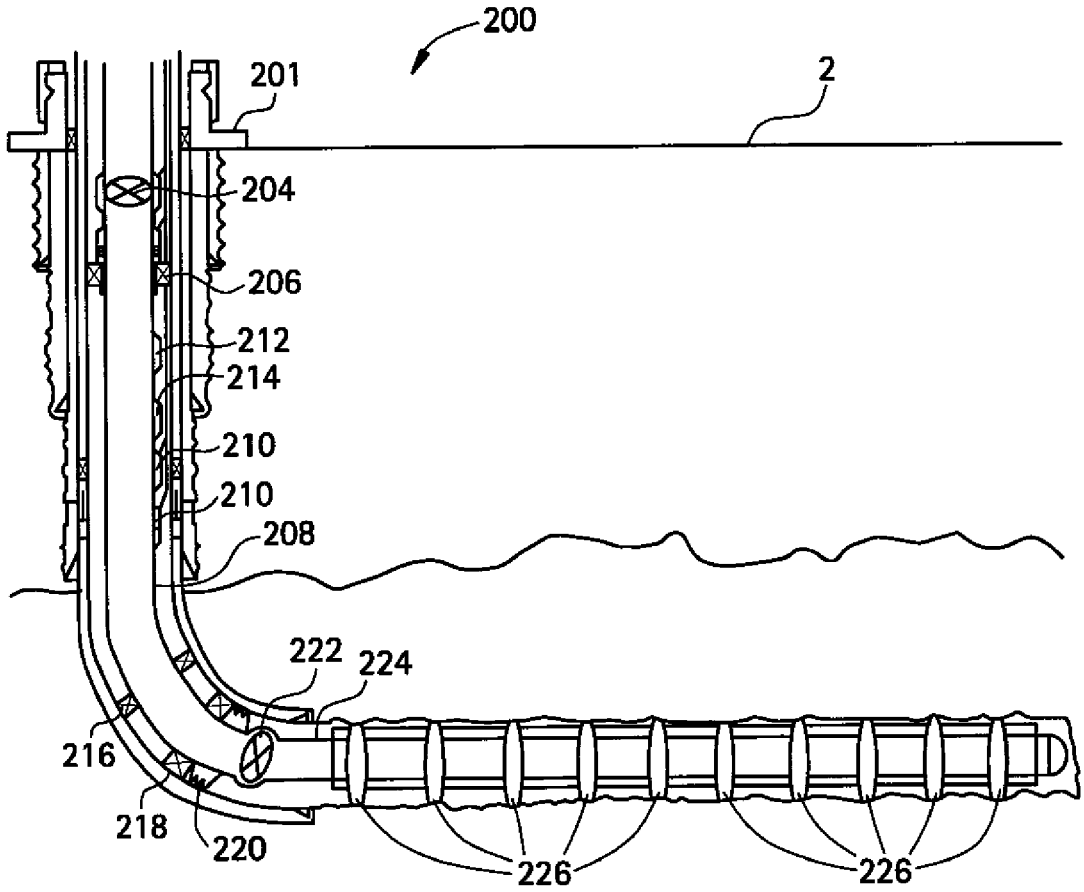

FIGS. 10A and 10B are schematic side elevation views, with some portions broken away to reveal the inner components of two subsea completions 120 and 200 which may have some or all of their components comprised of one or more ferrous alloys of the invention. Referring to FIG. 10A, completion 120 includes a wellhead 3 in a seabed 2, casings 118, 126, and 134, and production tubing 135 deployed using a tubing hanger 5, casing shoes 128, 130, and 146, and annulus valves 122, 124 for accessing annuli between casings 132 and 134, and production tubing 135 and casing 134, respectively. Seven small diameter tubing lines 4A and 4B enter the completion from the top, and are provided for controlling various components of the completion. A downhole safety valve 125 and annulus safety valve packer 127 are provided. One small diameter tubing line terminates at downhole safety valve 125, and six small diameter tubing lines pass through downhole safety valve 125. Another two small diameter tubing lines are used to operate annulus safety valve packer 127, with the four remaining small diameter tubing lines passing through annulus safety valve packer 127 and continuing down the completion. One of the four remaining small diameter tubing lines terminates at a chemical injection valve 138, two others at flow control valves 148, 150, and the last actually splits into two tubes, one of each terminating at respective gauge units 142, 152. Also provided is a gas-lift valve 136, a production packer 140, a contingency mechanical sliding sleeve 144 with choke for lateral bore, a liner hanger 154, a tubing/slick joint 156, a defector 158, a diverted tubing 160, sand screens 162, 166, screen hanger 164, lateral shoe 168, and tail pipe 170. Produced oil is illustrated at 172. FIG. 10B illustrates another completion 200 within the invention, including a wellhead 201 supporting production tubing 202, a downhole safety valve 204 annulus safety valve packer 206, liner 208, two mandrels 210 with gas-lift valves, chemical injection valve 212, gauge mandrel 214 including a permanent downhole gauge, a production packer 216 fitted to a polished bore receptacle, a liner hanger 220 and packer 218, a full bore isolation valve 222 with pressure cycle operation, a screen liner 224, and swell packers 226. Any of the components normally made from metallic materials may be comprised of one or more ferrous alloys of the invention.

Specific oilfield applications of the inventive ferrous alloys and apparatus include stimulation treatments Stimulation treatments fall into two main groups, hydraulic fracturing treatments and matrix treatments. Fracturing treatments are performed above the fracture pressure of the reservoir formation and create a highly conductive flow path between the reservoir and the wellbore. Matrix treatments are performed below the reservoir fracture pressure and generally are designed to restore the natural permeability of the reservoir following damage to the near-wellbore area.

In the oilfield context, a "wellbore" may be any type of well, including, but not limited to, a producing well, a non-producing well, an injection well, a fluid disposal well, an experimental well, an exploratory well, and the like. Wellbores may be vertical, horizontal, deviated some angle between vertical and horizontal, and combinations thereof, for example a vertical well with a non-vertical component.

Examples of Inventive Alloys

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description making apparent to those skilled in the art how these several forms of the present invention may be embodied in practice.

Corrosion is a complex type of damage that can result from multiple sources; therefore the exact behavior of various alloys cannot be precisely predicted in different oilfield environments. The important criteria with respect to corrosion in oil and gas environments are temperature, concentrations of sulfides ($H_2S$), carbon dioxides ($CO_2$) and halides (in particular chlorides). The presence of water and its chemical composition also plays an important role. In either designing or selecting alloys for oilfield applications, primary consideration are given to cracking; including sulfide stress cracking at low temperatures as well as stress-corrosion cracking generally at higher temperatures. All cracking and weight loss, pitting and crevice corrosion are reduced with austenitic alloys of high PRE and MARC numbers. In addition to providing strengths, the inventive carbon-plus-nitrogen alloys, owing to their high PRE and MARC numbers as well as austenitic microstructure are anticipated to outperform many current alloys and at a lower cost estimate.

Table 6 presents a list of inventive ferrous alloys with their chemical composition ($Cr_{eq}$ and $Ni_{eq}$), yield strength, ultimate tensile strength, PRE (Pitting Resistance Equivalence, according to various definitions) and MARC (Measure of Alloying for Resistance to Corrosion) numbers. Of the listed alloying elements, note that contents in chromium (Cr), manganese (Mn), nitrogen (N) and carbon (C) vary significantly. Content in chromium (Cr) range between 12 wt. % and 28 wt. %; content in manganese (Mn) range between 12 wt. % and 30 wt. %; contents in nitrogen (N) and carbon (C) each ranged between 0.4 wt. % and 1.2 wt. %. Note that both the yield strength (YS) and the ultimate tensile strength (UTS) increase to the greatest extents as a result of increases in the contents of carbon (C) and nitrogen (N); i.e. the richer carbon-plus-nitrogen alloys are the strongest. The effect on strength of the other alloying elements, all substitutional alloying elements, is comparatively low. Table 6 also shows the alloys of the invention have ultimate tensile strengths (UTS) that greatly surpass their yield strength (YS); a characteristic demonstrating that these alloys responds to cold working (work hardening) particularly well. For these novel alloys, cold working may thus be seen as an additional strengthening mechanism to raise their yield strength above 150 ksi (~1030 MPa). The last two columns of Table 6 show Pitting Resistance Equivalent (PRE) numbers as well as Measure of Alloying for Resistance to Corrosion (MARC) numbers and thus address the corrosion resistance of these alloys. Compared to commercial alloys, such as the austenitic alloys of Table 1 for which PRE and MARC numbers are largely restricted, the best inventive alloys of Table 6 have significantly greater PRE and MARC numbers because of the use of carbon (C) and nitrogen (N) as interstitial alloying elements. All PRE numbers in Table 4 are in excess of 20 with MARC numbers in excess of 30, and for the best alloys PRE and MARC numbers are as high as 40 and 60, respectively. The alloys of Table 6, with carbon-plus-nitrogen in solid solution, therefore exhibit outstanding corrosion resistance in a multitude of environments.

TABLE 6

Chemical compositions of a variety of inventive alloys, mechanical property estimates, PRE and MARC numbers to assess corrosion resistance.

| Alloy | Cr | Mo* | W (max) | Si (max) | V (max) | Nb, Ti, V (max) | Al | CrEq | Ni | Co | Mn |
|---|---|---|---|---|---|---|---|---|---|---|---|
| #1 | 12.0 | 0.3 | 0.1 | 1.0 | 0.1 | 0.1 | 0.5 | 13.7 | 1.0 | 0.0 | 12.0 |
| #2 | 18.0 | 0.3 | 0.1 | 1.0 | 0.1 | 0.1 | 0.5 | 19.7 | 1.0 | 0.0 | 12.0 |
| #3 | 24.0 | 0.3 | 0.1 | 1.0 | 0.1 | 0.1 | 0.5 | 25.7 | 1.0 | 0.0 | 12.0 |
| #4 | 30.0 | 0.3 | 0.1 | 0.5 | 0.1 | 0.1 | 0.5 | 30.9 | 1.5 | 0.0 | 12.0 |
| #5 | 18.0 | 0.3 | 0.1 | 0.5 | 0.1 | 0.1 | 0.5 | 18.9 | 1.5 | 0.0 | 12.0 |
| #6 | 18.0 | 0.3 | 0.1 | 0.5 | 0.1 | 0.1 | 0.5 | 18.9 | 1.5 | 0.0 | 18.0 |
| #7 | 24.0 | 0.3 | 0.1 | 0.5 | 0.1 | 0.1 | 0.5 | 24.9 | 3.0 | 0.0 | 8.0 |
| #8 | 24.0 | 0.3 | 0.1 | 0.5 | 0.1 | 0.1 | 0.5 | 24.9 | 3.0 | 0.0 | 8.0 |
| #9 | 24.0 | 0.3 | 0.1 | 0.5 | 0.1 | 0.1 | 0.5 | 24.9 | 3.0 | 0.0 | 8.0 |
| #10 | 24.0 | 0.3 | 0.1 | 0.5 | 0.1 | 0.1 | 0.5 | 24.9 | 1.0 | 0.0 | 16.0 |
| #11 | 24.0 | 0.3 | 0.1 | 0.5 | 0.1 | 0.1 | 0.5 | 24.9 | 1.0 | 0.0 | 16.0 |
| #12 | 24.0 | 0.3 | 0.1 | 0.5 | 0.1 | 0.1 | 0.5 | 24.9 | 1.0 | 0.0 | 16.0 |
| #13 | 28.0 | 0.3 | 0.1 | 0.3 | 0.1 | 0.1 | 0.2 | 28.6 | 2.0 | 0.0 | 14.0 |
| #14 | 28.0 | 0.3 | 0.1 | 0.3 | 0.1 | 0.1 | 0.2 | 28.6 | 2.0 | 0.0 | 14.0 |
| #15 | 28.0 | 0.3 | 0.1 | 0.3 | 0.1 | 0.1 | 0.2 | 28.6 | 2.0 | 0.0 | 14.0 |
| #15 | 28.0 | 0.3 | 0.1 | 0.3 | 0.1 | 0.1 | 0.2 | 28.6 | 2.0 | 0.0 | 24.0 |
| #16 | 28.0 | 0.3 | 0.1 | 0.3 | 0.1 | 0.1 | 0.2 | 28.6 | 2.0 | 0.0 | 24.0 |
| #17 | 28.0 | 0.3 | 0.1 | 0.3 | 0.0 | 0.1 | 0.2 | 28.6 | 3.5 | 0.0 | 24.0 |
| #18 | 28.0 | 0.3 | 0.1 | 0.3 | 0.0 | 0.1 | 0.2 | 28.6 | 4.0 | 0.0 | 30.0 |
| #19 | 28.0 | 0.3 | 0.1 | 0.3 | 0.0 | 0.1 | 0.2 | 28.6 | 4.0 | 0.0 | 30.0 |
| #20 | 28.0 | 0.3 | 0.1 | 0.3 | 0.0 | 0.1 | 0.2 | 28.6 | 2.0 | 2.0 | 30.0 |

| Alloy | N | C | NiEq | YS (MPa) | YS (ksi) | UTS (MPa) | UTS (ksi) | PRE (3a) | PRE (3b) | MARC (4) |
|---|---|---|---|---|---|---|---|---|---|---|
| #1 | 0.5 | 0.7 | 43.0 | 626 | 91 | 1310 | 190 | 20 | 31.1 | 30.1 |
| #2 | 0.5 | 0.7 | 43.0 | 648 | 94 | 1310 | 190 | 26 | 37.1 | 36.1 |
| #3 | 0.6 | 0.8 | 49.0 | 753 | 109 | 1450 | 210 | 34 | 46.8 | 46.1 |
| #4 | 0.6 | 0.8 | 49.5 | 765 | 111 | 1430 | 208 | 40 | 52.8 | 52.0 |
| #5 | 0.6 | 0.8 | 49.5 | 721 | 105 | 1430 | 208 | 28 | 40.8 | 40.0 |
| #6 | 0.6 | 0.8 | 52.5 | 721 | 105 | 1430 | 208 | 28 | 40.8 | 37.0 |
| #7 | 0.6 | 0.8 | 49.0 | 743 | 108 | 1428 | 207 | 34 | 46.8 | 47.6 |
| #8 | 0.6 | 0.8 | 49.0 | 743 | 108 | 1428 | 207 | 34 | 46.8 | 47.6 |
| #9 | 0.6 | 0.8 | 49.0 | 743 | 108 | 1428 | 207 | 34 | 46.8 | 47.6 |
| #10 | 0.8 | 1.0 | 63.0 | 908 | 132 | 1710 | 248 | 37 | 54.3 | 52.1 |
| #11 | 0.8 | 1.0 | 63.0 | 908 | 132 | 1710 | 248 | 37 | 54.3 | 52.1 |
| #12 | 0.8 | 1.0 | 63.0 | 908 | 132 | 1710 | 248 | 37 | 54.3 | 52.1 |
| #13 | 0.6 | 0.8 | 51.0 | 750 | 109 | 1416 | 206 | 38 | 50.8 | 48.8 |
| #14 | 0.8 | 1.0 | 63.0 | 915 | 133 | 1695 | 246 | 41 | 58.3 | 56.8 |
| #15 | 0.6 | 0.8 | 51.0 | 750 | 109 | 1416 | 206 | 38 | 50.8 | 48.8 |
| #15 | 0.8 | 1.0 | 68.0 | 915 | 133 | 1695 | 246 | 41 | 58.3 | 51.8 |
| #16 | 1.0 | 1.2 | 80.0 | 1080 | 157 | 1974 | 287 | 44 | 65.8 | 59.8 |
| #17 | 1.0 | 1.2 | 61.5 | 1078 | 157 | 1972 | 286 | 44 | 65.8 | 59.5 |
| #18 | 1.1 | 1.2 | 88.0 | 1125 | 163 | 2057 | 299 | 46 | 69.5 | 58.3 |
| #19 | 1.1 | 1.2 | 88.0 | 1125 | 163 | 2057 | 299 | 46 | 69.5 | 58.3 |
| #20 | 1.0 | 1.2 | 83.0 | 1078 | 157 | 1974 | 287 | 44 | 65.8 | 56.8 |

*With 3% Mo, strengths are practically identical, PRE and MARC numbers are increased by 10, but hard precipitates (e.g. carbides) often form, requiring post-casting heat-treatments.

Figure 11:
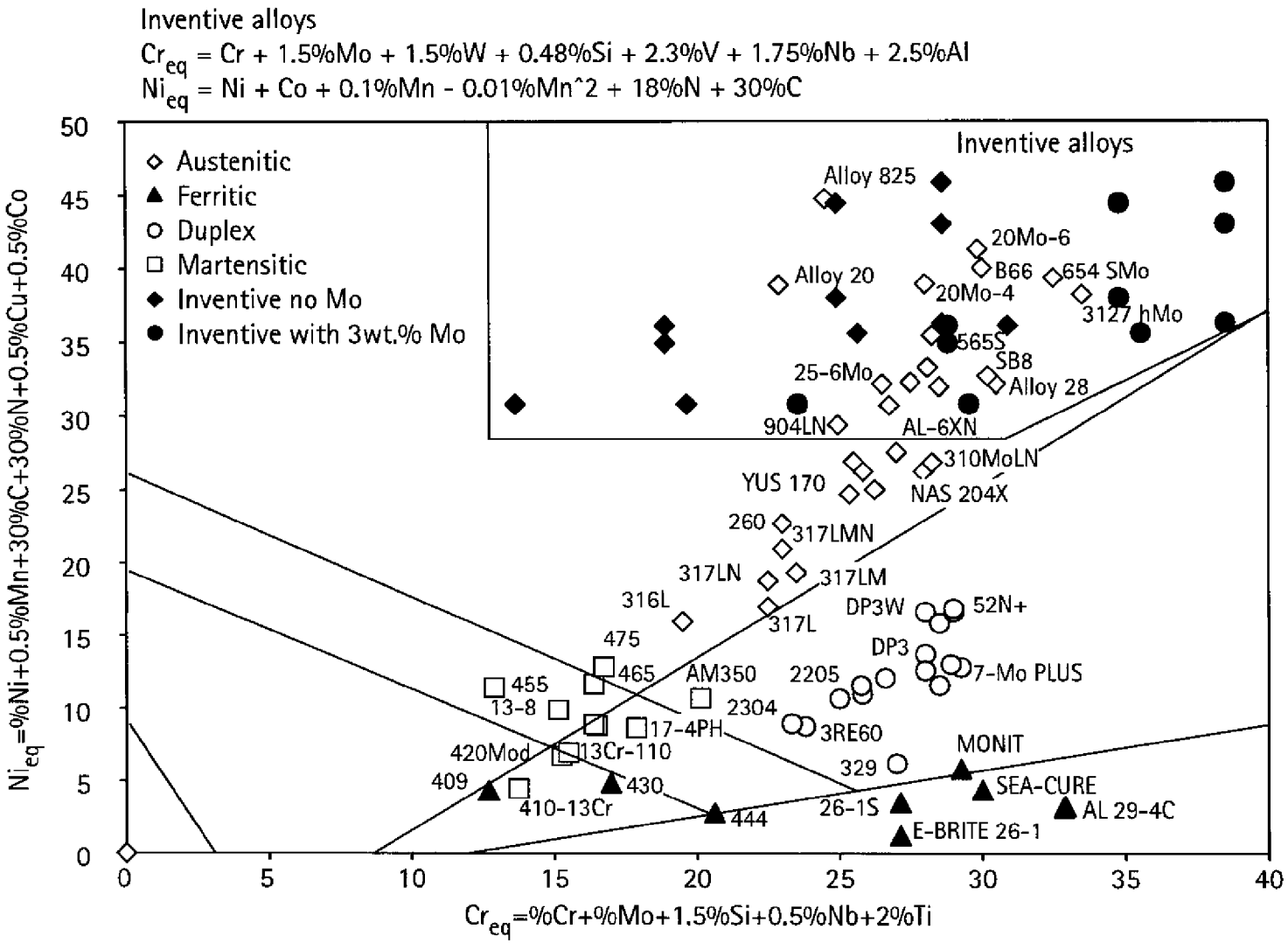
FIG. 11 is a modified Schaeffer diagram showing how the ferrous alloys of this invention compare to the commercial alloys of Table 1. The inventive alloys are plotted using $Cr_{Eq}$ and $Ni_{Eq}$ definitions more appropriate for nitrogen enriched alloys.
Figure 12A:
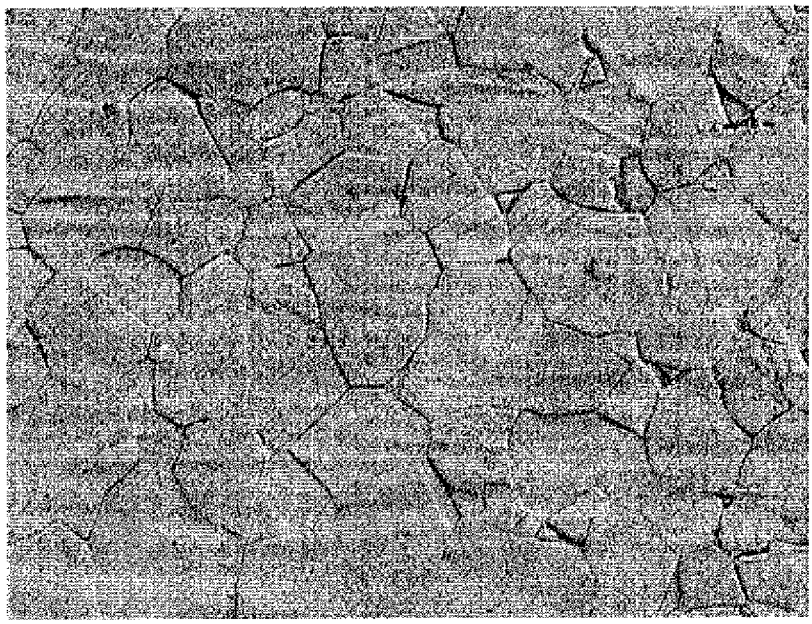
FIGS. 12A and 12B are scanning electron micrographs of two different ferrous alloys of the invention.
Figure 12B:
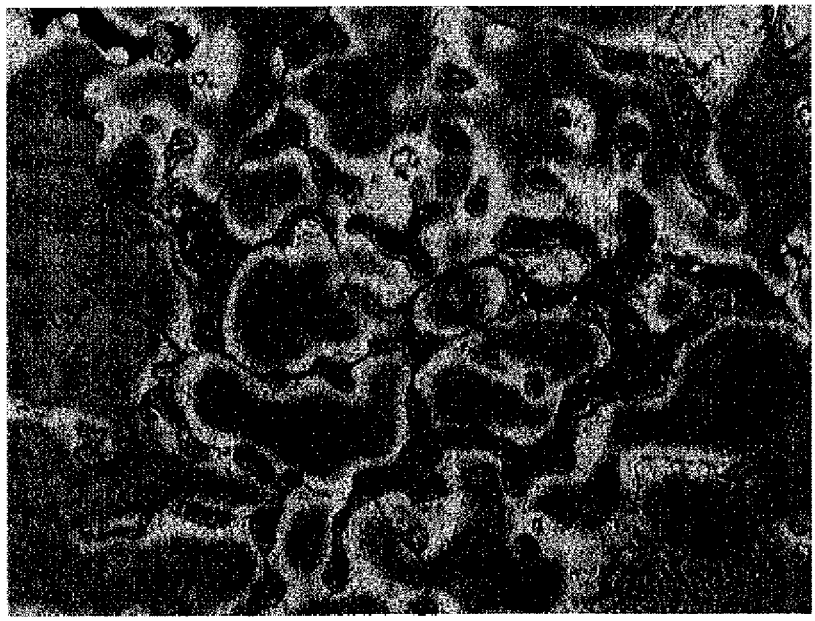
Figure 13A:
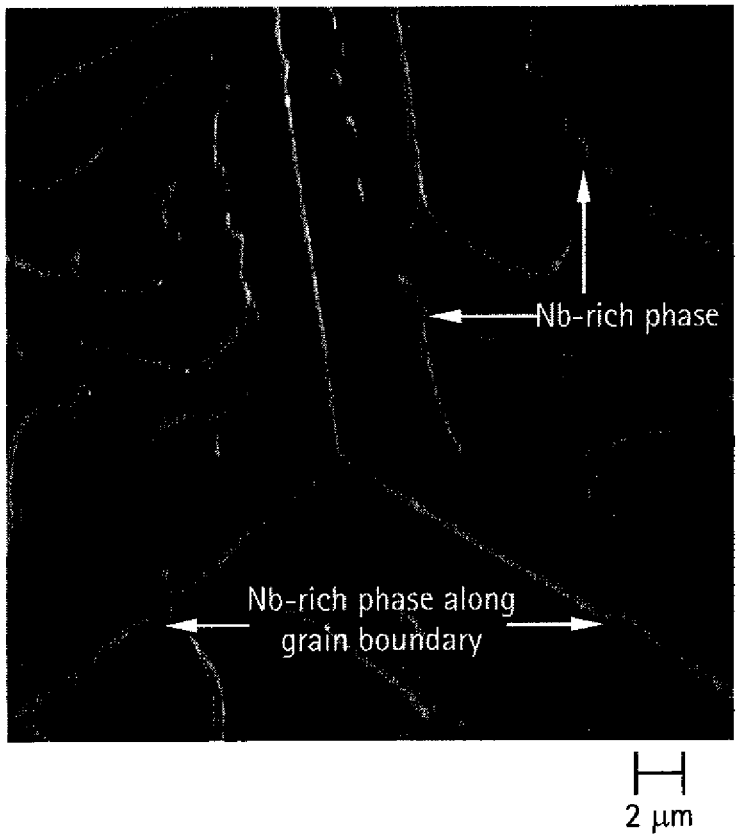
FIGS. 13A and 13B show niobium carbides produced in the presence of 1 wt. % niobium in several of the inventive alloys. These carbides may be dissolved through high-temperature annealing and rapid cooling
Figure 13B:
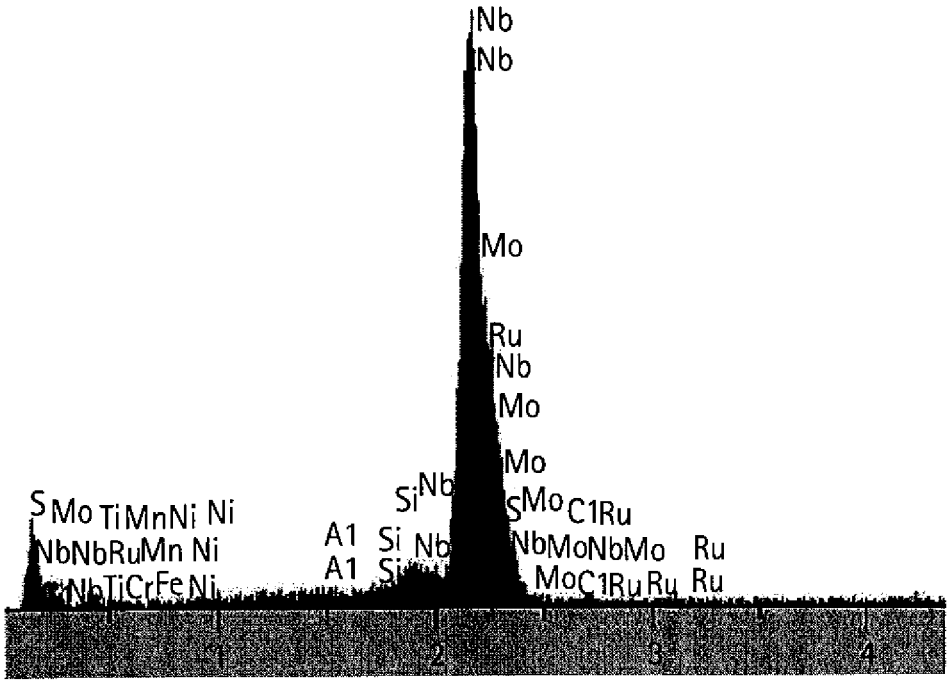

FIG. 11 shows such a Schaeffer-type diagram where alloy microstructure is mapped as a function of alloying elements, conveniently regrouped in an additive fashion among ferrite (α) stabilizers and austenite (γ) stabilizers using $Cr_{eq}$ and $Ni_{eq}$ equivalent numbers—recall that chromium (Cr) stabilizes ferrite (α), whereas nickel (Ni) stabilizes austenite (γ)—. Superimposed on FIG. 11 are also the alloys of Table 1, along with additional grades. Specifically are mapped in FIG. 11 commercial austenitic steels, commercial ferritic steels, commercial duplex stainless steels, commercial martensitic steels, and the alloys of the invention (in FIG. 11 they are represented by the black diamonds). Though Schaeffer diagrams properly apply to rapidly solidified alloys, as found for instance with fusion welds, note that these different alloys are mapped on the Schaeffer-type diagram where they would be expected to be; including the ferritic steels, which upon rapid cooling, become martensitic. In FIG. 11, the $Cr_{eq}$ and $Ni_{eq}$ definitions for the x and y-axes well illustrate that nitrogen (N) and carbon (C) are 18 and 30 times more effective in promoting austenite (γ) than nickel (Ni); i.e. carbon (C) and nitrogen (N) may be seen as low-cost substitutes for nickel (Ni). However, though effects of these two non-metallic elements is described as additive, carbon (C) and nitrogen (N) are conventionally not utilized at the same time and in concentrations over 0.4 wt. %. In contrast, the alloys of the present invention use carbon (C) and nitrogen (N) simultaneously and, if using the $Cr_{eq}$ and $Ni_{eq}$ definitions shown on the x and y-axes of FIG. 11, the inventive alloys would not fit within the graph boundaries, as corresponding nickel equivalent number ($Ni_{eq}$) exceeds 50. Nonetheless, by adopting a more conservative definition for $Cr_{eq}$ and $Ni_{eq}$, truly developed for high-nitrogen alloys and only applied to the inventive ferrous alloys, the innovative ferrous alloys may be represented on FIG. 11. These modified definitions of $Cr_{eq}$ and $Ni_{eq}$ are shown in the insert caption in FIG. 11. Note that the contributions of carbon (C) and nitrogen (N) are attenuated in comparisons to the definitions shown on the x and y-axes; though the definitions are different, the boundary lines are practically unchanged; thus enabling using two different definitions for these equivalences on the same diagram. Regardless the definitions of $Cr_{eq}$ and $Ni_{eq}$, it may be seen that the inventive alloys are fully austenitic. In fact all alloys of the present invention are characterized by $Ni_{eq}$ of at least 30, using the most conservative $Ni_{eq}$ of FIG. 11, whereas $Cr_{eq}$ ranges from about 13 to 38. The typical microstructure of the inventive ferrous alloys is a single-phase austenitic alloy, as shown in FIG. 12A. In stark contrast, FIG. 12B shows the type of microstructure that must be avoided, as found with certain alloys when manganese (Mn) content and rates of cooling may too low. The formation of carbides along grain boundaries is well known to be particularly damaging to the corrosion resistance. Microstructures such as in FIG. 12B or FIGS. 13A and B, where niobium carbide phases are shown, are avoidable using a post-casting heat treatment, as described in FIG. 14.

Figure 14:
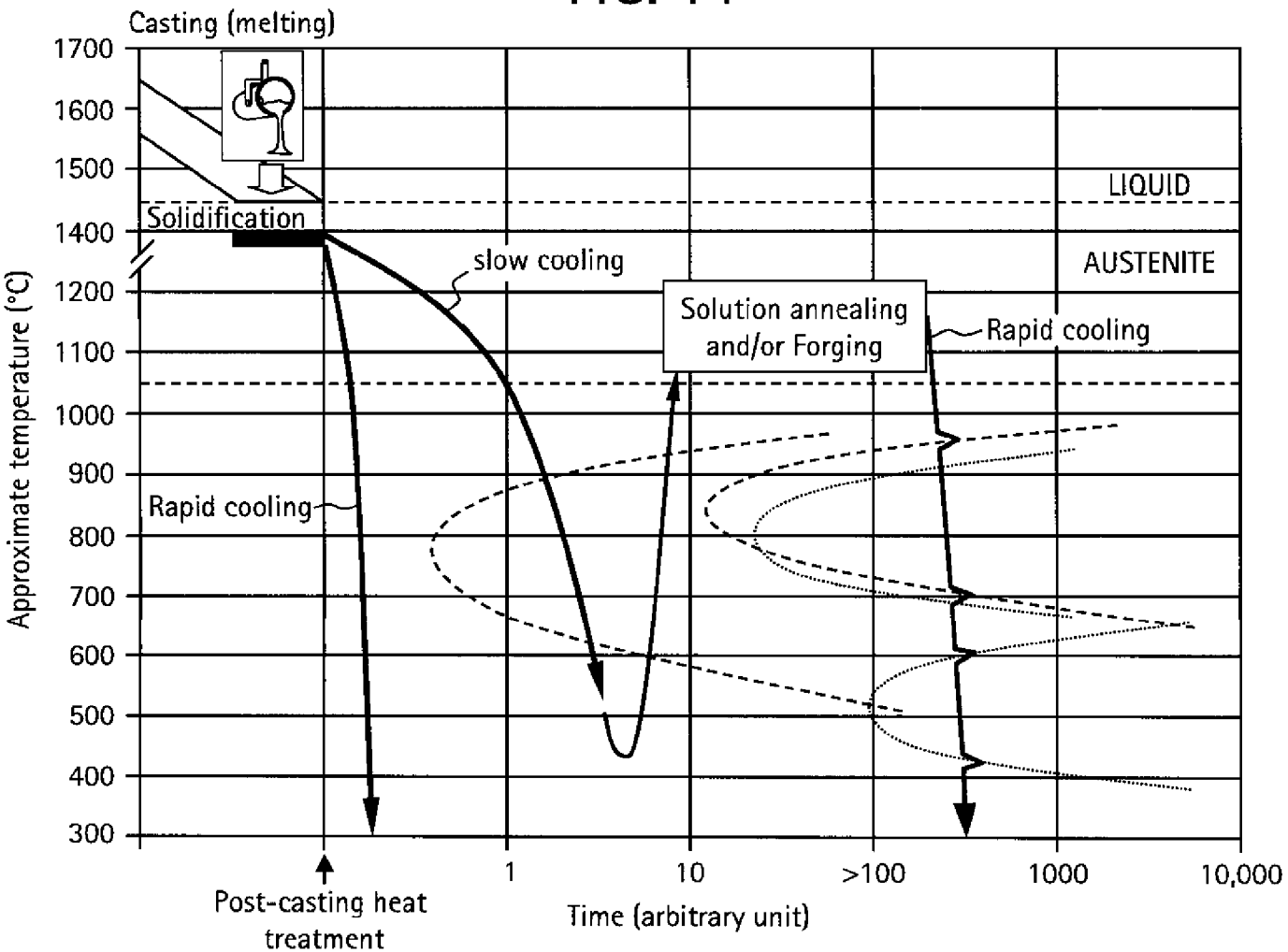
FIG. 14 shows an exemplary CCT (Continuous Cooling Transformation) diagram for alloys of this invention. The graphical representation is solely for description purposes and illustrates a typical heat-treat schedule for the inventive alloys.

FIG. 14 depicts a general Cooling-Temperature-Transformation (CTT) diagram with cooling curves to prevent the formation of equilibrium phases such as carbides, nitrides, carbo-nitrides, sigma, chi, among several possible phases that may be observed in the inventive alloys. FIG. 14 is only for explanatory purposes to discuss types of post-casting heat-treatments needed to avoid the formation of deleterious phases regarding corrosion and values for the temperature and the time are arbitrary. In FIG. 14, these phases that typically reduce corrosion resistance are represented by a set of C-shape curves. On the left of those C-shape curves, the phases in question are not formed; on their right they have formed. Also mapped in FIG. 14 are the temperature ranges where under equilibrium conditions the inventive alloys are either liquid or austenitic. At the highest temperature, above approximately 1450° C., the inventive alloys are liquid. Between approximately 1050° C. (1922° F.) and their melting temperatures, the inventive alloys are austenitic, as was shown by the Shaffer diagram of FIG. 11. Below approximately 1050° C. (1922° F.), but above approximately 350° C. (662° F.), prolonged exposure or slow cooling for higher temperatures will promote the formation of the phases represented by the C-shaped curves. In FIG. 14 is shown that slow cooling may be detrimental (i.e. the cooling curve intersects one or several of the C-shape curves). In contrast, rapid cooling from temperature where the alloy is austenitic under equilibrium conditions enables to bypass the low temperature phases represented by the C-shape curves. After casting, the inventive are preferentially rapidly cooled so as to create kinetically-unfavorable conditions for these low-temperature equilibrium phases to precipitate. In the case of slow cooling, subsequent solution annealing (optionally forging) may be conducted to dissolve these low-temperature phases; this high-temperature heat-treatment must then be followed by a rapid cooling.

Figure 15:
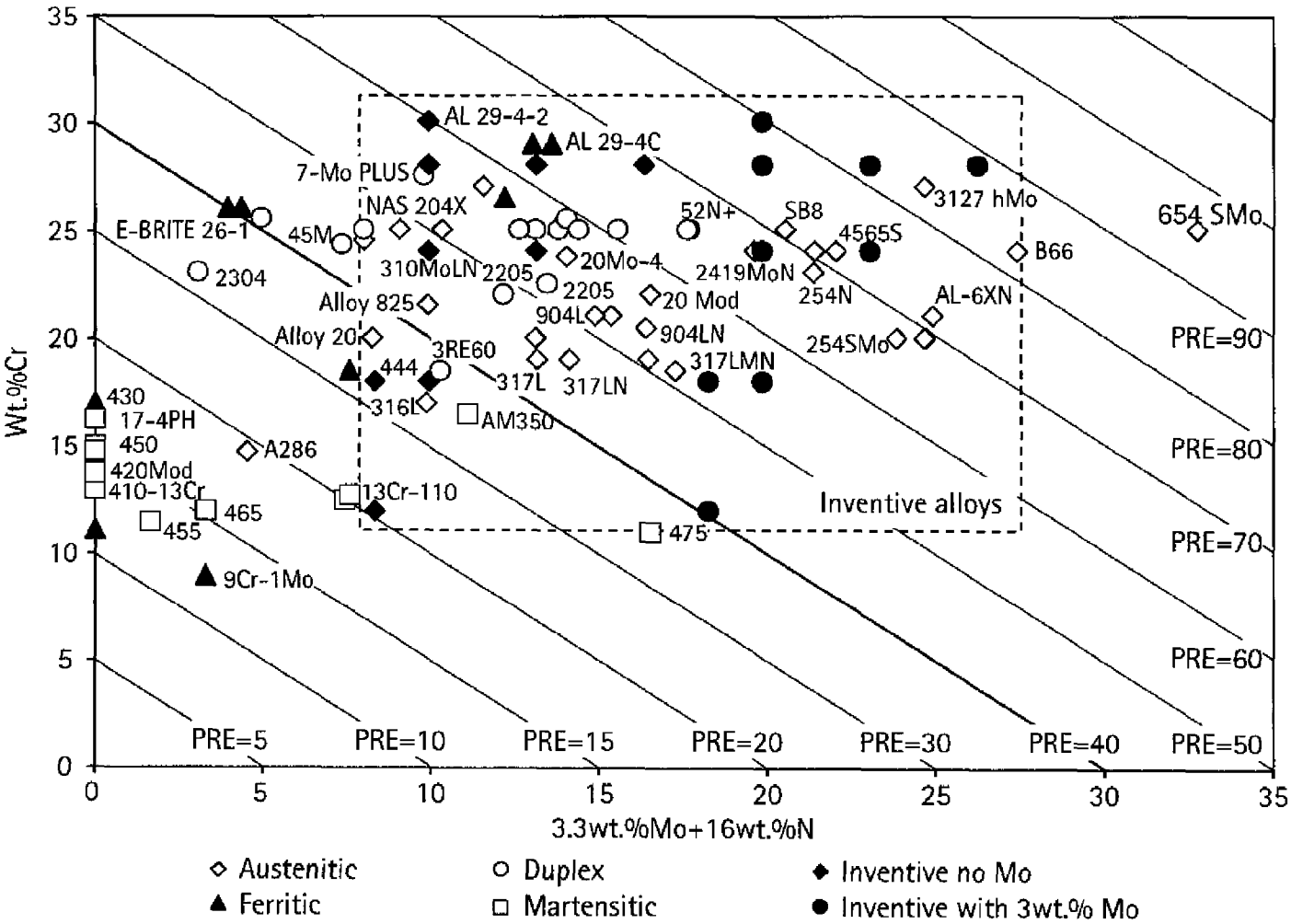
FIG. 15 is a corrosion map comparing the PRE (Pitting Corrosion Equivalence) values of the commercial alloys of Table 1 with the inventive ferrous alloys.

FIG. 15 is PRE map to assess pitting corrosion resistance, and in general resistance to many forms of corrosion. On the x-axis is the PRE definition minus the chromium (Cr) that is placed on the y-axis. Included in FIG. 15 are all previous commercial alloys of FIG. 11 with the inventive ferrous alloys. It may be seen that the inventive ferrous alloys have comparable chromium (Cr) content as commercial alloys, but because of the added nitrogen (N), they are shifted far to the right, thus exhibiting PRE numbers beyond 60. This is in stark contrast with the alloys listed in Table 2.

Figure 16:
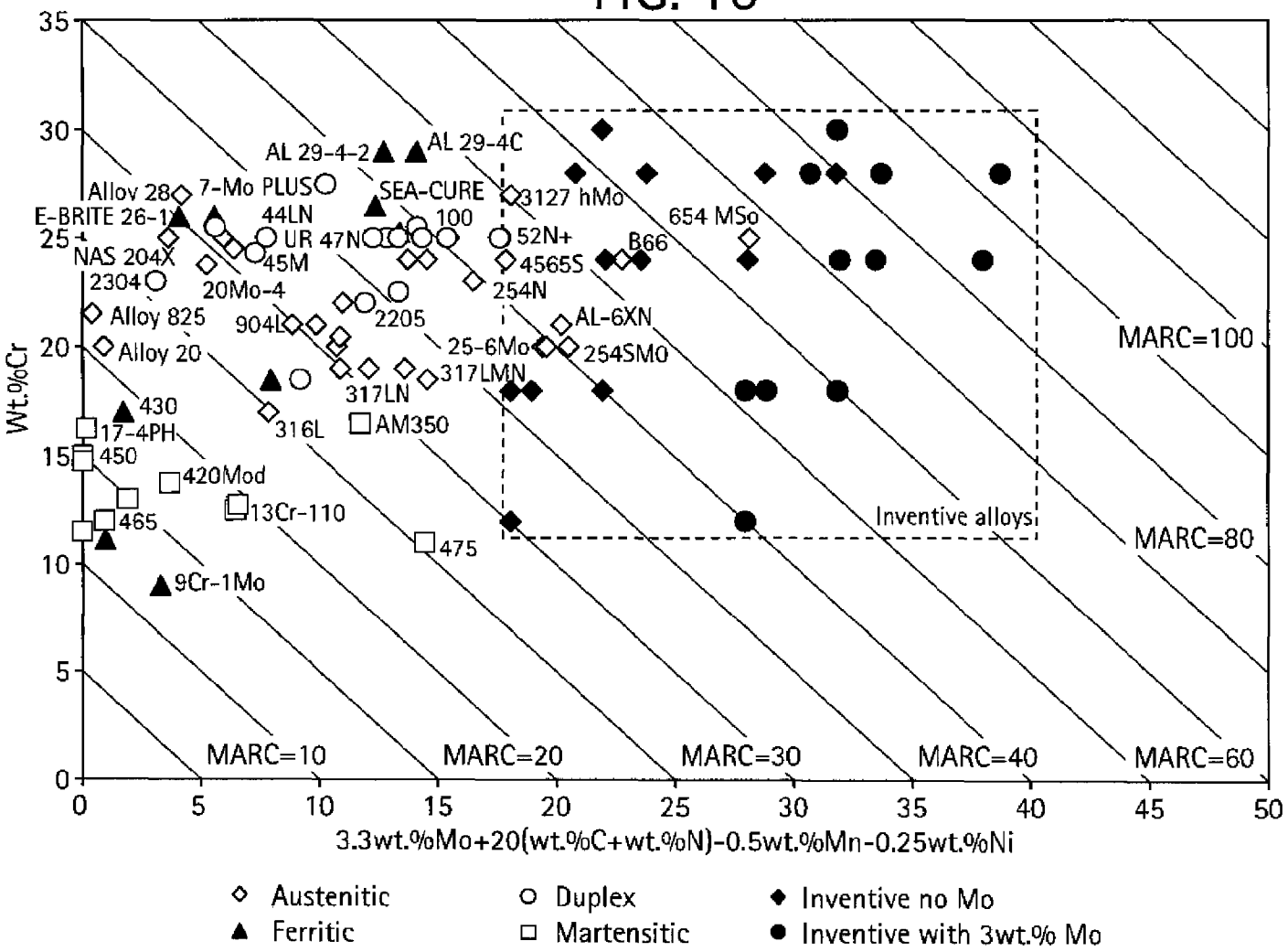
FIG. 16 is a corrosion map showing the MARC (measure of Alloying for Corrosion Resistance) values of commercial alloys and inventive alloys.

FIG. 16 is a complementary map including the effects of carbon (C), manganese (Mn) and nickel (Ni) and showing the MARC numbers for the commercial alloys of the previous figures and the inventive alloys. Like FIG. 15, the inventive ferrous alloys are seen to possess greater MARC numbers than commercial alloys because of their high carbon-plus-nitrogen content.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising one or more components at least partially made of a corrosion resistant ferrous alloy comprising:

about 28 wt %-chromium;
about 0.3 wt % molybdenum;
about 0.1 wt % tungsten;
about 0.3 wt % silicon;
about 0.1 wt % vanadium;
about 0.2 wt % aluminum;
about 2.0 wt % nickel;
about 24 wt % manganese;
about 1.0 wt % nitrogen; and 1.2 wt % carbon; and the balance iron and inevitable impurities.

2. An apparatus comprising one or more components at least partially made of a corrosion resistant ferrous alloy comprising:

about 28 wt % chromium;
about 0.3 wt % molybdenum;
about 0.1 wt % tungsten;
about 0.3 wt % silicon;
about 0.2 wt % aluminum;
about 2.0 wt % nickel;
about 30 wt % manganese;
about 1.1 wt % nitrogen; and
about 1.2 wt % carbon.

3. An apparatus comprising one or more components at least partially made of a corrosion resistant ferrous alloy comprising:

about 28 wt % chromium;
about 0.3 wt % molybdenum;
about 0.1 wt % tungsten;
about 0.3 wt % silicon;
about 0.2 wt % aluminum;
about 4.0 wt % nickel;
about 30 wt % manganese;
about 1.0 wt % nitrogen; and
about 1.2 wt % carbon.

4. An apparatus comprising one or more components at least partially made of a corrosion resistant ferrous alloy comprising:

about 28 wt % chromium;
about 0.3 wt % molybdenum;
about 0.1 wt % tungsten;
about 0.3 wt % silicon;
about 0.05 wt % vanadium;
about 0.2 wt % aluminum;
about 2.0 wt % nickel;
about 14.0 wt % manganese;
about 2.0 wt % cobalt;
about 1.0 wt % nitrogen; and
1.2 wt % carbon; and the balance iron and inevitable impurities.

5. The apparatus of claim 4, wherein the alloy further comprises about 0.05 wt % niobium or titanium.

6. A process for making a corrosion resistant ferrous and austenitic alloy for use in a wellbore comprising:

melting and mixing ferrous alloy constituents at a temperature from about 1,400° C. to about 2,580° C. to provide a liquid alloy, the constituents comprising:
about 12 wt % to about 28 wt % chromium;
about 0 wt % to about 0.3 wt % molybdenum;
about 0 wt % to about 0.1 wt % tungsten;
about 0.1 wt % to about 1.0 wt % silicon;
about 0 wt % to about 0.1 wt % vanadium;
about 0.2 wt % to about 0.5 wt % aluminum;
about 1.0 wt % to about 4.0 wt % nickel;
about 8.0 wt % to about 30 wt % manganese;
about 0 wt % to about 2.0 wt % cobalt;
about 0.8 wt % to about 1.2 wt % nitrogen;
about 0.7 wt % to about 1.2 wt % carbon; and the balance iron and inevitable impurities;

cooling the liquid alloy in a nitrogen enriched environment to form an austenitic alloy; wherein the alloy is cooled at a rate greater than or equal to 50° C./min; and enriching the austenitic alloy at a temperature ranging from about 1400° C. to about 1600° C. and pressure of 0.1 MPa up to about 0.3 MPa.

7. The process of claim 6, wherein the alloy comprises:

about 28 wt % chromium;
about 0.3 wt % molybdenum;
about 0.1 wt % tungsten;
about 0.3 wt % silicon;
about 0.1 wt % vanadium;
about 0.2 wt % aluminum;
about 2.0 wt % nickel;
about 24 wt % manganese;
about 1.0 wt % nitrogen; and
about 1.2 wt % carbon.

8. The process of claim 6, wherein the alloy comprises:

28 wt % chromium;
0.3 wt % molybdenum;
0.1 wt % tungsten;
0.3 wt % silicon;
0.2 wt % aluminum;
4.0 wt % nickel;
30 wt % manganese;
1.1 wt % nitrogen; and
1.2 wt % carbon.

9. The process of claim 6, wherein the alloy comprises:

about 28 wt % chromium;
about 0.3 wt % molybdenum;
about 0.1 wt % tungsten;
about 0.3 wt % silicon;
about 0.2 wt % aluminum;
about 2.0 wt % nickel;
about 30 wt % manganese;
about 1.1 wt % nitrogen; and
about 1.2 wt % carbon.

10. The process of claim 9, further comprising about 0.05 wt % niobium.

11. The process of claim 10, further comprising 0.05 wt % titanium.

12. The process of claim 6, wherein the alloy comprises:

about 28 wt % chromium;
about 0.3 wt % molybdenum;
about 0.1 wt % tungsten;
about 0.3 wt % silicon;
about 0.1 wt % vanadium;
about 0.2 wt % aluminum;
about 2.0 wt % nickel;
about 14 wt % manganese;
about 2.0 wt % cobalt;
about 1.0 wt % nitrogen; and
about 1.2 wt % carbon.

* * * * *